US010937369B2

(12) United States Patent
Kang et al.

(10) Patent No.: US 10,937,369 B2
(45) Date of Patent: Mar. 2, 2021

(54) STAGE AND EMISSION CONTROL DRIVER HAVING THE SAME

(71) Applicant: Samsung Display Co., Ltd., Yongin-si (KR)

(72) Inventors: Chul Kyu Kang, Yongin-si (KR); Dae Hyun Kim, Yongin-si (KR); Sung Hwan Kim, Yongin-si (KR); Soo Hee Oh, Yongin-si (KR); Dong Sun Lee, Yongin-si (KR); Sang Moo Choi, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 16/681,265

(22) Filed: Nov. 12, 2019

(65) Prior Publication Data

US 2020/0152127 A1 May 14, 2020

(30) Foreign Application Priority Data

Nov. 12, 2018 (KR) ..... 10-2018-0138314

(51) Int. Cl.
*G09G 3/3258* (2016.01)

(52) U.S. Cl.
CPC ... *G09G 3/3258* (2013.01); *G09G 2300/0426* (2013.01); *G09G 2310/08* (2013.01); *G09G 2330/028* (2013.01)

(58) Field of Classification Search
CPC .. G09G 3/3208; G09G 3/3225; G09G 3/3233; G09G 3/3266; G09G 3/3275;
(Continued)

(56) References Cited

U.S. PATENT DOCUMENTS 6,618,111 B1 9/2003 Nagata et al.
8,339,424 B2 12/2012 Jeong et al.
(Continued)

FOREIGN PATENT DOCUMENTS

EP 3 258 464 A1 12/2017
KR 10-2014-0025149 A 3/2014
KR 10-2017-0133578 A 12/2017

OTHER PUBLICATIONS

Extended European Search Report for corresponding European Application No. 19208734.4, dated Feb. 25, 2020, 13 pages.
(Continued)

*Primary Examiner* — Nelson M Rosario
(74) *Attorney, Agent, or Firm* — Lewis Roca Rothgerber Christie LLP

(57) ABSTRACT

Provided herein may be a stage and an emission control driver having the same. The stage may include an output unit configured to supply a voltage of a first or second power supply to a first output terminal depending on voltages of first and second nodes, an input unit configured to control the voltages of the second node and a third node, a first signal processing unit configured to control the voltage of the first node, and supply a voltage corresponding to the first node to a second output terminal, a second signal processing unit including a second capacitor coupled between the third node and a fifth node, the second signal processing unit being configured to control the voltage of the first node, and control a potential difference between opposite terminals of the second capacitor, and a third signal processing unit configured to control the voltage of the second node.

41 Claims, 14 Drawing Sheets

(58) Field of Classification Search
CPC ... G09G 2300/0861; G09G 2310/0286; G09G 2310/08; G09G 2330/02
See application file for complete search history.

(56) References Cited

U.S. PATENT DOCUMENTS

| | | | | |
|---|---|---|---|---|
| 9,368,069 | B2 * | 6/2016 | Woo | G09G 3/3266 |
| 9,548,026 | B2 | 1/2017 | Jang | |
| 10,311,781 | B2 | 6/2019 | Lee et al. | |
| 2009/0179888 | A1 | 7/2009 | Yamashita et al. | |
| 2010/0026619 | A1 | 2/2010 | Umezaki | |
| 2010/0085341 | A1 | 4/2010 | Hasegawa et al. | |
| 2010/0188316 | A1 | 7/2010 | Jang | |
| 2012/0188290 | A1 | 7/2012 | Park et al. | |
| 2012/0320008 | A1 | 12/2012 | Takahashi et al. | |
| 2013/0044854 | A1 | 2/2013 | Yonemaru et al. | |
| 2013/0314139 | A1 | 11/2013 | Umezaki | |
| 2014/0055444 | A1 | 2/2014 | Jang | |
| 2014/0337876 | A1 | 11/2014 | McCarthy et al. | |
| 2017/0337874 | A1 | 11/2017 | Toyomura et al. | |
| 2017/0337876 | A1 | 11/2017 | Kim et al. | |
| 2017/0337878 | A1 | 11/2017 | Kim et al. | |
| 2017/0345366 | A1 | 11/2017 | Jang | |
| 2017/0352328 | A1 | 12/2017 | Jeong et al. | |
| 2017/0365211 | A1 * | 12/2017 | Lee | G09G 3/3275 |
| 2018/0075810 | A1 | 3/2018 | Kim et al. | |
| 2018/0330673 | A1 | 11/2018 | Kang et al. | |
| 2019/0019462 | A1 | 1/2019 | Kim et al. | |
| 2019/0130836 | A1 | 5/2019 | Liu et al. | |
| 2019/0287457 | A1 | 9/2019 | Lee et al. | |
| 2019/0295673 | A1 | 9/2019 | Umezaki | |
| 2019/0348442 | A1 | 11/2019 | Umezaki | |
| 2020/0152127 | A1 | 5/2020 | Kang | |

OTHER PUBLICATIONS

Earth Is Home, Apr. 2006, https://electronics.stackexchange.com/questions/229658/can-current-flow-both-ways-through-a-transistor (Year: 2006).

* cited by examiner

STAGE AND EMISSION CONTROL DRIVER HAVING THE SAME

CROSS-REFERENCE TO RELATED APPLICATION

This application claims priority to, and the benefit of, Korean patent application number 10-2018-0138314 filed on Nov. 12, 2018, the entire disclosure of which is incorporated herein in its entirety by reference.

BACKGROUND

1. Field

Various embodiments of the present disclosure relate to a stage, and an emission control driver having the same.

2. Description of Related Art

An organic light emitting display (OLED) has advantages in that the response speed thereof is high, and in that it is operated with low power consumption.

An emission control driver provided in the OLED may control emission times of pixels by supplying emission control signals to emission control lines. For this operation, the emission control driver includes a plurality of stages coupled to the respective emission control lines.

Each of the stages may include a plurality of transistors and a capacitor. Frequent charge and discharge operations of the capacitors provided in the stages may increase power consumption of the OLED that is operated with low power.

SUMMARY

Various embodiments of the present disclosure are directed to a stage configured such that a capacitor provided in the stage may be prevented from being charged or discharged while an emission control signal is maintained at a low voltage, and an emission control driver having the stage.

An embodiment of the present disclosure may provide a stage including an output unit configured to supply a voltage of a first power supply or a voltage of a second power supply to a first output terminal depending on a voltage of a first node and on a voltage of a second node, an input unit configured to control the voltage of the second node and a voltage of a third node in response to signals supplied to a first input terminal, a second input terminal, and a fourth input terminal, a first signal processing unit configured to control the voltage of the first node in response to the voltage of the second node, and to supply a voltage corresponding to the first node to a second output terminal, a second signal processing unit including a second capacitor coupled between the third node and a fifth node, the second signal processing unit being configured to control the voltage of the first node in response to the signal supplied to the second input terminal and to a signal supplied to a third input terminal, and being configured to control a potential difference between opposite terminals of the second capacitor in response to the signal supplied to the second input terminal and the voltage of the first power supply, and a third signal processing unit configured to control the voltage of the second node in response to the voltage of the first power supply and the signal supplied to the fourth input terminal.

The first power supply may be set to a gate-off voltage, and the second power supply may be set to a gate-on voltage.

The signal supplied to the first input terminal may include a start signal or a signal output from the first output terminal of a preceding stage, and the signal supplied to the fourth input terminal may include a control node start signal or a signal output from the second output terminal of the preceding stage.

The signal output from the first output terminal of the preceding stage or the start signal may overlap at least once with a first clock signal including the signal supplied to the second input terminal.

The signal output from the second output terminal of the preceding stage or the control node start signal may have a phase that is inverted from a phase of the signal output from the first output terminal of the preceding stage or the start signal.

The signal supplied to the second input terminal may include a first clock signal, and the signal supplied to the third input terminal may include a second clock signal.

The input unit may include a first transistor coupled between the first input terminal and the second node, and including a gate electrode coupled to the second input terminal, and a fourth transistor coupled between the fourth input terminal and the third node, and including a gate electrode coupled to the second input terminal.

The output unit may include a ninth transistor coupled between the first power supply and the first output terminal, and including a gate electrode coupled to the first node, and a tenth transistor coupled between the first output terminal and the second power supply, and including a gate electrode coupled to the second node.

The first signal processing unit may include an eighth transistor coupled between the first power supply and the first node, and including a gate electrode coupled to the second node, and a first capacitor coupled between the first power supply and the first node.

The second signal processing unit may include a fifth transistor coupled between the first power supply and the fifth node, and including a gate electrode coupled to the second input terminal, a sixth transistor coupled between the fifth node and the third input terminal, and including a gate electrode coupled to the third node, and a seventh transistor coupled between the fifth node and the first node, and including a gate electrode coupled to the third input terminal.

While the voltage of the second power supply is supplied to the first output terminal, the potential difference between the opposite terminals of the second capacitor may remain constant.

The third signal processing unit may include a second transistor coupled between the first power supply and a seventh node, and including a gate electrode coupled to the third node, a third transistor coupled between the seventh node and the third input terminal, and including a gate electrode coupled to the second node, and a third capacitor coupled between the seventh node and the second node.

The stage may further include a first stabilization unit coupled between the second signal processing unit and the third signal processing unit, and configured to control a voltage drop width of the third node, and a second stabilization unit coupled between the second node and a fourth node coupled to the first input terminal, the second stabilization unit being configured to control a voltage drop width of the second node.

The first stabilization unit may include an eleventh transistor coupled between the third signal processing unit and the third node, and including a gate electrode coupled to the second power supply.

The second stabilization unit may include a twelfth transistor coupled between the second node and the fourth node, and including a gate electrode coupled to the second power supply.

The input unit may include a first transistor coupled between the first input terminal and the second node, and including a gate electrode coupled to the second input terminal, a fourth transistor coupled between an eighth node and the third node, a sixteenth transistor coupled between the first power supply and the eighth node, and including a gate electrode coupled to the first input terminal, and a seventeenth transistor coupled between the eighth node and the second power supply, and including a gate electrode coupled to the first input terminal, and the fourth input terminal may be coupled to the first input terminal.

The second signal processing unit may include a fifth transistor coupled between the third input terminal and the fifth node, and including a gate electrode coupled to the second input terminal, a sixth transistor coupled between the fifth node and the third input terminal, and including a gate electrode coupled to the third node, and a seventh transistor coupled between the fifth node and the first node, and including a gate electrode coupled to the third input terminal.

The third signal processing unit may include a third capacitor coupled between the sixth node and a seventh node, and is configured to control a potential difference between opposite terminals of the third capacitor in response to the first power supply and the signals supplied to the first input terminal, the second input terminal, and the fourth input terminal.

The third signal processing unit may further include a second transistor coupled between the first power supply and the seventh node, and including a gate electrode coupled to the third node, a third transistor coupled between the seventh node and the third input terminal, and including a gate electrode coupled to the sixth node, and a fifteenth transistor coupled between the sixth node and the second node, and including a gate electrode coupled to the sixth node.

The input unit may include a first transistor coupled between the first input terminal and the second node, and including a gate electrode coupled to the second input terminal, a fourth transistor coupled between the fourth input terminal and the third node, and including a gate electrode coupled to the second input terminal, and a thirteenth transistor coupled between the first input terminal and the sixth node, and including a gate electrode coupled to the second input terminal.

While the voltage of the second power supply is supplied to the first output terminal, the potential difference between the opposite terminals of the third capacitor may remain constant.

The stage may further include a first stabilization unit coupled between the second signal processing unit and the third signal processing unit, and configured to control a voltage drop width of the third node, a second stabilization unit coupled between the second node and a fourth node that is coupled to the first input terminal, and configured to control a voltage drop width of the fourth node, and a third stabilization unit coupled between the input unit and the third signal processing unit, and configured to control a voltage drop width of the sixth node.

The input unit may include a first transistor coupled between the first input terminal and the second node, and including a gate electrode coupled to the second input terminal, a fourth transistor coupled between an eighth node and the third node, a thirteenth transistor coupled between the first input terminal and the sixth node, and including a gate electrode coupled to the second input terminal, a sixteenth transistor coupled between the first power supply and the eighth node, and including a gate electrode coupled to the first input terminal, and a seventeenth transistor coupled between the eighth node and the second power supply, and including a gate electrode coupled to the first input terminal, and the fourth input terminal may be coupled to the first input terminal.

An embodiment of the present disclosure may provide an emission control driver including a plurality of stages to supply emission signals to emission control lines. Each of the plurality of stages may include an output unit configured to supply a voltage of a first power supply or a second power supply to a first output terminal depending on voltages of a first node and a second node, an input unit configured to control the voltage of the second node and a voltage of a third node in response to signals supplied to a first input terminal, a second input terminal, and a fourth input terminal, a first signal processing unit configured to control the voltage of the first node in response to the voltage of the second node, and to supply a voltage corresponding to the first node to a second output terminal, a second signal processing unit including a second capacitor coupled between the third node and a fifth node, the second signal processing unit being configured to control the voltage of the first node in response to the signal supplied to the second input terminal and a signal supplied to a third input terminal, and to control a potential difference between opposite terminals of the second capacitor in response to the signal supplied to the second input terminal and the first power supply, and a third signal processing unit configured to control the voltage of the second node in response to the signal supplied to the first input terminal and the signal supplied to the fourth input terminal.

A 1st stage of the plurality of stages may include a 1st output unit configured to supply the voltage of the first power supply or the second power supply to a 1st first-output terminal depending on voltages of a 1st first-node and a 1st second-node, a 1st input unit configured to control the voltage of the 1st second-node and a voltage of a 1st third-node in response to a signal supplied to a 1st first-input terminal and a signal supplied to a 1st second-input terminal, a 1st first-signal processing unit configured to control the voltage of the 1st first-node in response to the voltage of the 1st second-node, and to supply a voltage corresponding to the 1st first-node to a 1st second-output terminal, a 1st second-signal processing unit coupled to the 1st third-node and configured to control the voltage of the 1st first-node in response to the signal supplied to the 1st second input terminal and the signal supplied to a 1st third input terminal, and a 1st third-signal processing unit configured to control the voltage of the 1st second-node in response to the signal supplied to the 1st first-input terminal.

A signal output from the 1st second-output terminal may be supplied to the fourth input terminal of a 2nd stage.

The first input terminal may be supplied with a signal output from the first output terminal of a preceding stage or a start signal, and the fourth input terminal may be supplied with a signal output from the second output terminal of the preceding stage or a control node start signal.

The signal output from the first output terminal of the preceding stage or the start signal may overlap at least once with a first clock signal supplied to the second input terminal, and the signal output from the second output terminal of the preceding stage or the control node start signal may include a signal having a phase that is inverted from a phase of the signal output from the first output terminal of the preceding stage or the start signal.

The input unit may include a first transistor coupled between the first input terminal and the second node, and including a gate electrode coupled to the second input terminal, and a fourth transistor coupled between the fourth input terminal and the third node, and including a gate electrode coupled to the second input terminal.

The output unit may include a ninth transistor coupled between the first power supply and the first output terminal, and including a gate electrode coupled to the first node, and a tenth transistor coupled between the first output terminal and the second power supply, and including a gate electrode coupled to the second node.

The first signal processing unit may include an eighth transistor coupled between the first power supply and the first node, and including a gate electrode coupled to the second node, and a first capacitor coupled between the first power supply and the first node.

The second signal processing unit may include a fifth transistor coupled between the first power supply and the fifth node, and including a gate electrode coupled to the second input terminal, a sixth transistor coupled between the fifth node and the third input terminal, and including a gate electrode coupled to the third node, and a seventh transistor coupled between the fifth node and the first node, and including a gate electrode coupled to the third input terminal.

While the voltage of the second power supply is supplied to the first output terminal, the potential difference between the opposite terminals of the second capacitor may remain constant.

The third signal processing unit may include a second transistor coupled between the first power supply and a seventh node, and including a gate electrode coupled to the third node, a third transistor coupled between the seventh node and the third input terminal, and including a gate electrode coupled to the second node, and a third capacitor coupled between the seventh node and the second node.

The emission control driver may further include a first stabilization unit coupled between the second signal processing unit and the third signal processing unit, and configured to control a voltage drop width of the third node, and a second stabilization unit coupled between the second node and a fourth node that is coupled to the first input terminal, the second stabilization unit being configured to control a voltage drop width of the second node.

The first stabilization unit may include an eleventh transistor coupled between the third signal processing unit and the third node, and including a gate electrode coupled to the second power supply, and the second stabilization unit may include a twelfth transistor coupled between the second node and the fourth node, and including a gate electrode coupled to the second power supply.

The input unit may include a first transistor coupled between the first input terminal and the second node, and including a gate electrode coupled to the second input terminal, a fourth transistor coupled between an eighth node and the third node, a sixteenth transistor coupled between the first power supply and the eighth node, and including a gate electrode coupled to the first input terminal, and a seventeenth transistor coupled between the eighth node and the second power supply, and including a gate electrode coupled to the first input terminal, and wherein the fourth input terminal is coupled to the first input terminal.

The second signal processing unit may include a fifth transistor coupled between the third input terminal and the fifth node, and including a gate electrode coupled to the second input terminal, a sixth transistor coupled between the fifth node and the third input terminal, and including a gate electrode coupled to the third node, and a seventh transistor coupled between the fifth node and the first node, and including a gate electrode coupled to the third input terminal.

The third signal processing unit may include a third capacitor coupled between a sixth node and a seventh node, and controls a potential difference between opposite terminals of the third capacitor in response to the first power supply and the signals supplied to the first input terminal, the second input terminal, and the fourth input terminal.

The third signal processing unit may further include a second transistor coupled between the first power supply and the seventh node, and including a gate electrode coupled to the third node, a third transistor coupled between the seventh node and the third input terminal, and including a gate electrode coupled to the sixth node, and a fifteenth transistor coupled between the sixth node and the second node, and including a gate electrode coupled to the sixth node.

The input unit may include a first transistor coupled between the first input terminal and the second node, and including a gate electrode coupled to the second input terminal, a fourth transistor coupled between the fourth input terminal and the third node, and including a gate electrode coupled to the second input terminal, and a thirteenth transistor coupled between the first input terminal and the sixth node, and including a gate electrode coupled to the second input terminal.

While the voltage of the second power supply is supplied to the first output terminal, the potential difference between the opposite terminals of the third capacitor may remain constant.

The emission control driver may further include a first stabilization unit coupled between the second signal processing unit and the third signal processing unit and configured to control a voltage drop width of the third node, a second stabilization unit coupled between the second node and a fourth node that is coupled to the first input terminal, the second stabilization unit being configured to control a voltage drop width of the fourth node, and a third stabilization unit coupled between the input unit and the third signal processing unit, and configured to control a voltage drop width of the sixth node.

The input unit may include a first transistor coupled between the first input terminal and the second node, and including a gate electrode coupled to the second input terminal, a fourth transistor coupled between an eighth node and the third node, a thirteenth transistor coupled between the first input terminal and the sixth node, and including a gate electrode coupled to the second input terminal, a sixteenth transistor coupled between the first power supply and the eighth node, and including a gate electrode coupled to the first input terminal, and a seventeenth transistor coupled between the eighth node and the second power supply, and including a gate electrode coupled to the first input terminal, and the fourth input terminal may be coupled to the first input terminal.

DETAILED DESCRIPTION

Figure 1:
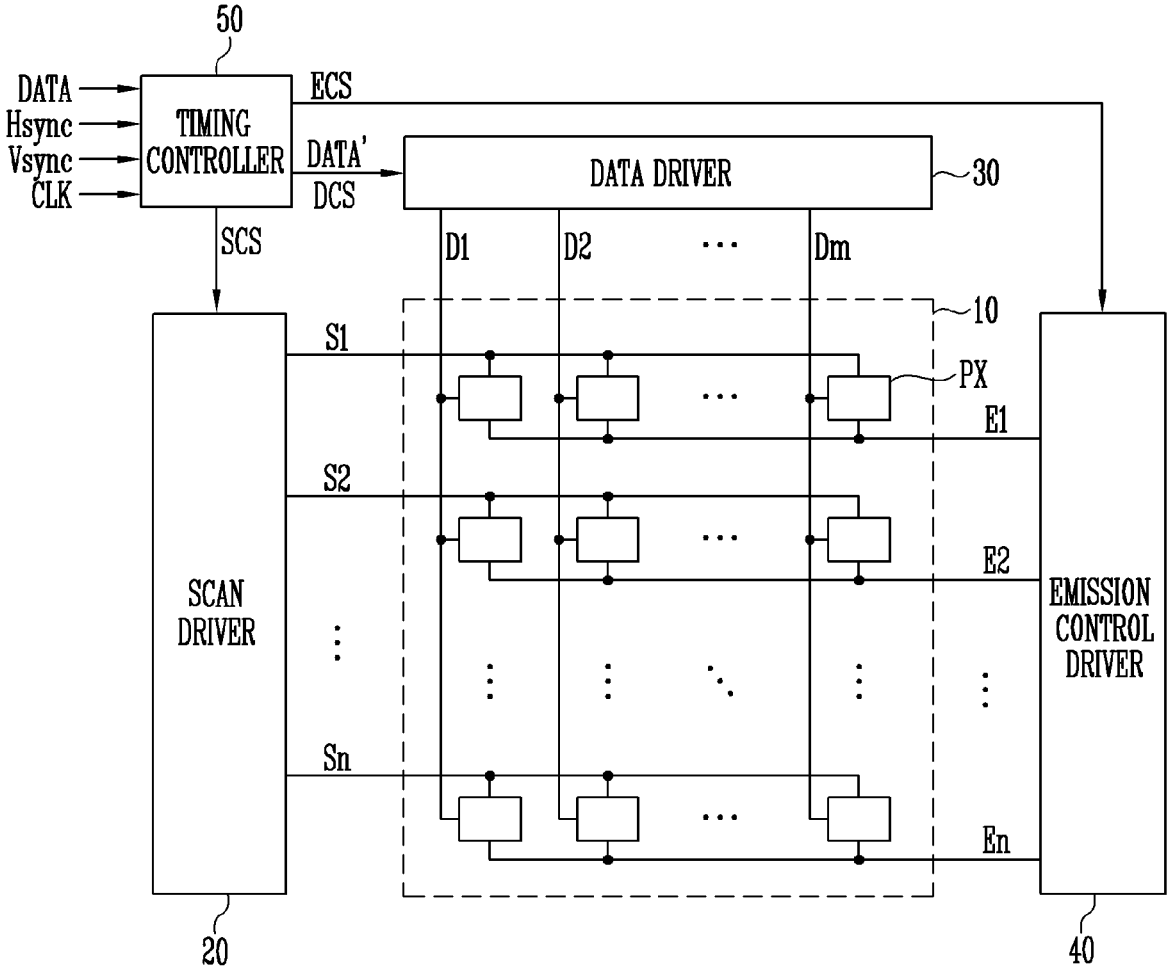
FIG. 1 is a diagram illustrating a display device in accordance with embodiments of the present disclosure.

Features of the inventive concept and methods of accomplishing the same may be understood more readily by reference to the detailed description of embodiments and the accompanying drawings. Hereinafter, embodiments will be described in more detail with reference to the accompanying drawings. The described embodiments, however, may be embodied in various different forms, and should not be construed as being limited to only the illustrated embodiments herein. Rather, these embodiments are provided as examples so that this disclosure will be thorough and complete, and will fully convey the aspects and features of the present inventive concept to those skilled in the art. Accordingly, processes, elements, and techniques that are not necessary to those having ordinary skill in the art for a complete understanding of the aspects and features of the present inventive concept may not be described. Unless otherwise noted, like reference numerals denote like elements throughout the attached drawings and the written description, and thus, descriptions thereof will not be repeated. Further, parts not related to the description of the embodiments might not be shown to make the description clear. In the drawings, the relative sizes of elements, layers, and regions may be exaggerated for clarity.

Various embodiments are described herein with reference to sectional illustrations that are schematic illustrations of embodiments and/or intermediate structures. As such, variations from the shapes of the illustrations as a result, for example, of manufacturing techniques and/or tolerances, are to be expected. Further, specific structural or functional descriptions disclosed herein are merely illustrative for the purpose of describing embodiments according to the concept of the present disclosure. Thus, embodiments disclosed herein should not be construed as limited to the particular illustrated shapes of regions, but are to include deviations in shapes that result from, for instance, manufacturing. For example, an implanted region illustrated as a rectangle will, typically, have rounded or curved features and/or a gradient of implant concentration at its edges rather than a binary change from implanted to non-implanted region. Likewise, a buried region formed by implantation may result in some implantation in the region between the buried region and the surface through which the implantation takes place. Thus, the regions illustrated in the drawings are schematic in nature and their shapes are not intended to illustrate the actual shape of a region of a device and are not intended to be limiting. Additionally, as those skilled in the art would realize, the described embodiments may be modified in various different ways, all without departing from the spirit or scope of the present disclosure.

In the detailed description, for the purposes of explanation, numerous specific details are set forth to provide a thorough understanding of various embodiments. It is apparent, however, that various embodiments may be practiced without these specific details or with one or more equivalent arrangements. In other instances, well-known structures and devices are shown in block diagram form in order to avoid unnecessarily obscuring various embodiments.

It will be understood that, although the terms "first," "second," "third," etc., may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section described below could be termed a second element, component, region, layer or section, without departing from the spirit and scope of the present disclosure.

Spatially relative terms, such as "beneath," "below," "lower," "under," "above," "upper," and the like, may be used herein for ease of explanation to describe one element or feature's relationship to another element(s) or feature(s) as illustrated in the figures. It will be understood that the spatially relative terms are intended to encompass different orientations of the device in use or in operation, in addition to the orientation depicted in the figures. For example, if the device in the figures is turned over, elements described as "below" or "beneath" or "under" other elements or features would then be oriented "above" the other elements or features. Thus, the example terms "below" and "under" can encompass both an orientation of above and below. The device may be otherwise oriented (e.g., rotated 90 degrees or at other orientations) and the spatially relative descriptors used herein should be interpreted accordingly. Similarly, when a first part is described as being arranged "on" a second part, this indicates that the first part is arranged at an upper side or a lower side of the second part without the limitation to the upper side thereof on the basis of the gravity direction.

It will be understood that when an element, layer, region, or component is referred to as being "on," "connected to," or "coupled to" another element, layer, region, or component, it can be directly on, connected to, or coupled to the other element, layer, region, or component, or one or more intervening elements, layers, regions, or components may be present. However, "directly connected/directly coupled" refers to one component directly connecting or coupling another component without an intermediate component. Meanwhile, other expressions describing relationships between components such as "between," "immediately between" or "adjacent to" and "directly adjacent to" may be construed similarly. In addition, it will also be understood that when an element or layer is referred to as being "between" two elements or layers, it can be the only element or layer between the two elements or layers, or one or more intervening elements or layers may also be present.

The terminology used herein is for the purpose of describing particular embodiments only and is not intended to be limiting of the present disclosure. As used herein, the singular forms "a" and "an" are intended to include the plural forms as well, unless the context clearly indicates otherwise. It will be further understood that the terms "comprises," "comprising," "have," "having," "includes," and "including," when used in this specification, specify the presence of the stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

As used herein, the term "substantially," "about," "approximately," and similar terms are used as terms of approximation and not as terms of degree, and are intended to account for the inherent deviations in measured or calculated values that would be recognized by those of ordinary skill in the art. "About" or "approximately," as used herein, is inclusive of the stated value and means within an acceptable range of deviation for the particular value as determined by one of ordinary skill in the art, considering the measurement in question and the error associated with measurement of the particular quantity (i.e., the limitations of the measurement system). For example, "about" may mean within one or more standard deviations, or within ±30%, 20%, 10%, 5% of the stated value. Further, the use of "may" when describing embodiments of the present disclosure refers to "one or more embodiments of the present disclosure."

When a certain embodiment may be implemented differently, a specific process order may be performed differently from the described order. For example, two consecutively described processes may be performed substantially at the same time or performed in an order opposite to the described order.

The electronic or electric devices and/or any other relevant devices or components according to embodiments of the present disclosure described herein may be implemented utilizing any suitable hardware, firmware (e.g. an application-specific integrated circuit), software, or a combination of software, firmware, and hardware. For example, the various components of these devices may be formed on one integrated circuit (IC) chip or on separate IC chips. Further, the various components of these devices may be implemented on a flexible printed circuit film, a tape carrier package (TCP), a printed circuit board (PCB), or formed on one substrate. Further, the various components of these devices may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the spirit and scope of the embodiments of the present disclosure.

Unless otherwise defined, all terms (including technical and scientific terms) used herein have the same meaning as commonly understood by one of ordinary skill in the art to which the present inventive concept belongs. It will be further understood that terms, such as those defined in commonly used dictionaries, should be interpreted as having a meaning that is consistent with their meaning in the context of the relevant art and/or the present specification, and should not be interpreted in an idealized or overly formal sense, unless expressly so defined herein.

FIG. 1 is a diagram illustrating a display device in accordance with embodiments of the present disclosure.

Referring to FIG. 1, a display device in accordance with an embodiment of the present disclosure may include a display unit 10, a scan driver 20, a data driver 30, an emission control driver 40, and a timing controller 50.

The display unit 10 may include a plurality of pixels PX that are coupled with scan lines S1 to Sn, data lines D1 to Dm, and emission control lines E1 to En, and that are arranged in the form of a matrix. The pixels PX may receive scan signals through the scan lines S1 to Sn, may receive data signals through the data lines D1 to Dm, and may receive emission control signals through the emission control lines E1 to En. The pixels PX may emit light at luminances corresponding to data signals supplied from the data lines D1 to Dm when scan signals are supplied from the scan lines S1 to Sn to the pixels PX.

The scan driver 20 may be coupled with the plurality of scan lines S1 to Sn, may generate scan signals in response to a scan driving control signal SCS from the timing controller 50, and may output the generated scan signals to the scan lines S1 to Sn. The scan driver 20 may be formed of a plurality of stage circuits. When scan signals are sequentially supplied to the scan lines S1 to Sn, the pixels PX may be selected on a horizontal line basis (e.g., on a line-by-line basis).

The data driver 30 may be coupled to the plurality of data lines D1 to Dm, may generate data signals based on compensated image data DATA' and a data driving control signal DCS from the timing controller 50, and may output the generated data signals to the data lines D1 to Dm. Each time a scan signal is supplied, the data signals supplied to the data lines D1 to Dm may be supplied to pixels PX selected by the scan signal. Then, the pixels PX may charge voltages corresponding to the data signals.

The emission control driver 40 may be coupled with the emission control lines E1 to En, may generate emission control signals in response to an emission driving control signal ECS from the timing controller 50, and may output the generated emission control signal to the emission control lines E1 to En. The emission control driver 40 may be formed of a plurality of stage circuits, and may control emission periods of the pixels PX by supplying the emission control signals to the emission control lines E1 to En.

The timing controller 50 may receive image data DATA, synchronization signals Hsync and Vsync, a clock signal CLK, etc. for controlling display of an image corresponding to the image data DATA. The timing controller 50 may image-process the input image data DATA, may generate compensated image data DATA' suitable for image display of the display unit 10, and may output the compensated image data DATA' to the data driver 30. The timing controller 50 may generate driving control signals SCS, DCS, and ECS for controlling the operations of the scan driver 20, the data driver 30, and the emission control driver 40 based on the synchronization signals Hsync and Vsync and the clock signal CLK. In detail, the timing controller 50 may generate a scan driving control signal SCS to supply the scan driving control signal SCS to the scan driver 20, may generate a data driving control signal DCS to supply the data driving control signal DCS to the data driver 30, and may generate an emission driving control signal ECS to supply the emission driving control signal ECS to the emission control driver 40.

Figure 2:
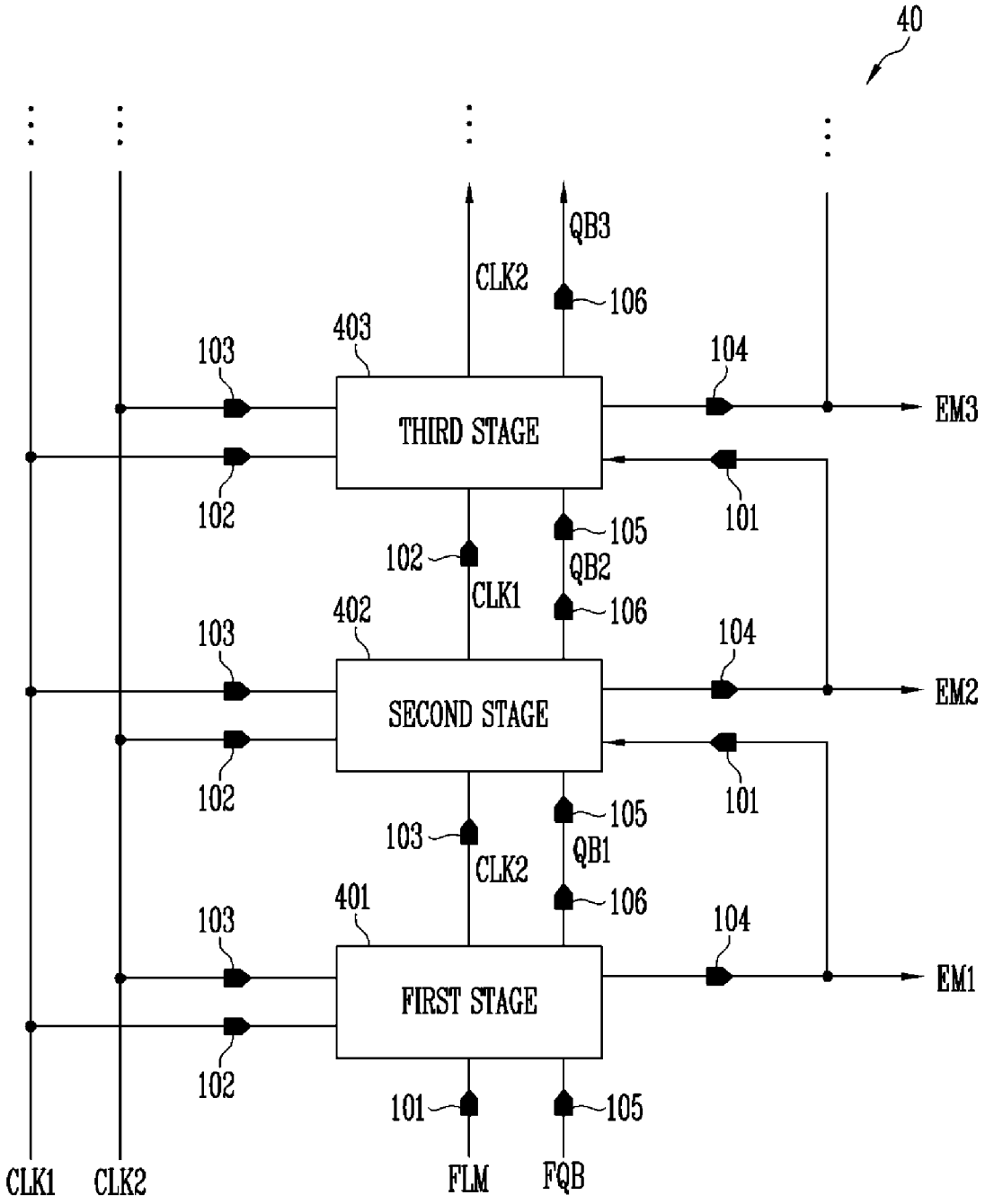
FIG. 2 is a diagram schematically illustrating an emission control driver illustrated in FIG. 1.

FIG. 2 is a diagram schematically illustrating the emission control driver 40 illustrated in FIG. 1.

Referring to FIG. 2, the emission control driver 40 in accordance with an embodiment of the present disclosure may include a plurality of stages 401, 402, 403, . . . to supply emission control signals to the emission control lines E1 to En. In the present embodiment, for the sake of explanation, only three stages 401, 402, and 403 are illustrated.

The stages 401, 402, and 403 may be driven by a start signal FLM and first and second clock signals CLK1 and CLK2, and may respectively output emission control signals EM1, EM2, and EM3. The emission driving control signal ECS provided from the timing controller 50 may include the start signal FLM and the first and second clock signals CLK1 and CLK2. Here, the stages 401, 402, and 403 may be implemented as the same circuit.

Each of the stages 401 to 403 includes a first input terminal 101, a second input terminal 102, a third input terminal 103, and a first output terminal 104.

The first input terminal 101 may be supplied with a start signal FLM or an emission control signal EM[i−1] of the preceding stage. The second input terminal 102 and the third input terminal 103 may be supplied with any one of the first and second clock signals CLK1 and CLK2. A signal output to the first output terminal 104 may be used as an emission control signal EM.

The first stage 401 of the stages 401, 402, and 403 may receive the start signal FLM, and each of the stages 402 and 403 other than the first stage 401 may receive the respective emission control signal EM1, EM2, EM3 of the preceding stage. Furthermore, the first stage 401 may directly receive the first and second clock signals CLK1 and CLK2, and each of the stages 402 and 403 other than the first stage 401 may receive any one of the first and second clock signals CLK1 and CLK2 from the preceding stage. In detail, the third stage 403, which is an odd-numbered stage other than the first stage 401, may receive the first clock signal CLK1 from the preceding stage, and may directly receive the second clock signal CLK2. The second stage 402, which is an even-numbered stage, may directly receive the first clock signal CLK1, and may receive the second clock signal CLK2 from the preceding stage.

In an embodiment of the present disclosure, the stages 401, 402, and 403 may be driven by a control node start signal FQB, and may output respective control node signals QB. The emission driving control signal ECS provided from the timing controller 50 may include the control node start signal FQB.

In this embodiment, each of the stages 401, 402, and 403 may further include a fourth input terminal 105 and a second output terminal 106. The fourth input terminal 105 may be supplied with the control node signal QB or the control node start signal FQB of the preceding stage. The second output terminal 106 may output the control node signal QB. The control node signal QB output from the second output terminal 106 may be supplied to the fourth input terminal 105 of the following/subsequent stage.

The first stage 401 of the stages 401, 402, and 403 may receive the control node start signal FQB, and each of the stages 402 and 403 other than the first stage 401 may receive the control node signal QB of the preceding stage.

The first stage 401 may output a first emission control signal EM1 in response to the start signal FLM, the control node start signal FQB, and the first and second clock signals CLK1 and CLK2, and may transmit the second clock signal CLK2, the first emission control signal EM1, and a first control node signal QB1 to the second stage 402.

The second stage 402 may output a second emission control signal EM2 in response to the first clock signal CLK1, and in response to the second clock signal CLK2, the first emission control signal EM1, and the first control node signal QB1 that are transmitted from the first stage 401, and may transmit the first clock signal CLK1, the second emission control signal EM2, and the second control node signal QB2 to the third stage 403.

The third stage 403 may output a third emission control signal EM3 in response to the second clock signal CLK2, and in response to the first clock signal CLK1, the second emission control signal EM2, and the second control node signal QB2 that are transmitted from the second stage 402, and may transmit the second clock signal CLK2, the third emission control signal EM3, and the third control node signal QB3 to a fourth stage.

However, in various embodiments of the present disclosure, the control node signal QB is not necessarily required. In other words, in an embodiment, the control node signal QB may be replaced with the emission control signal EM.

Figure 3:
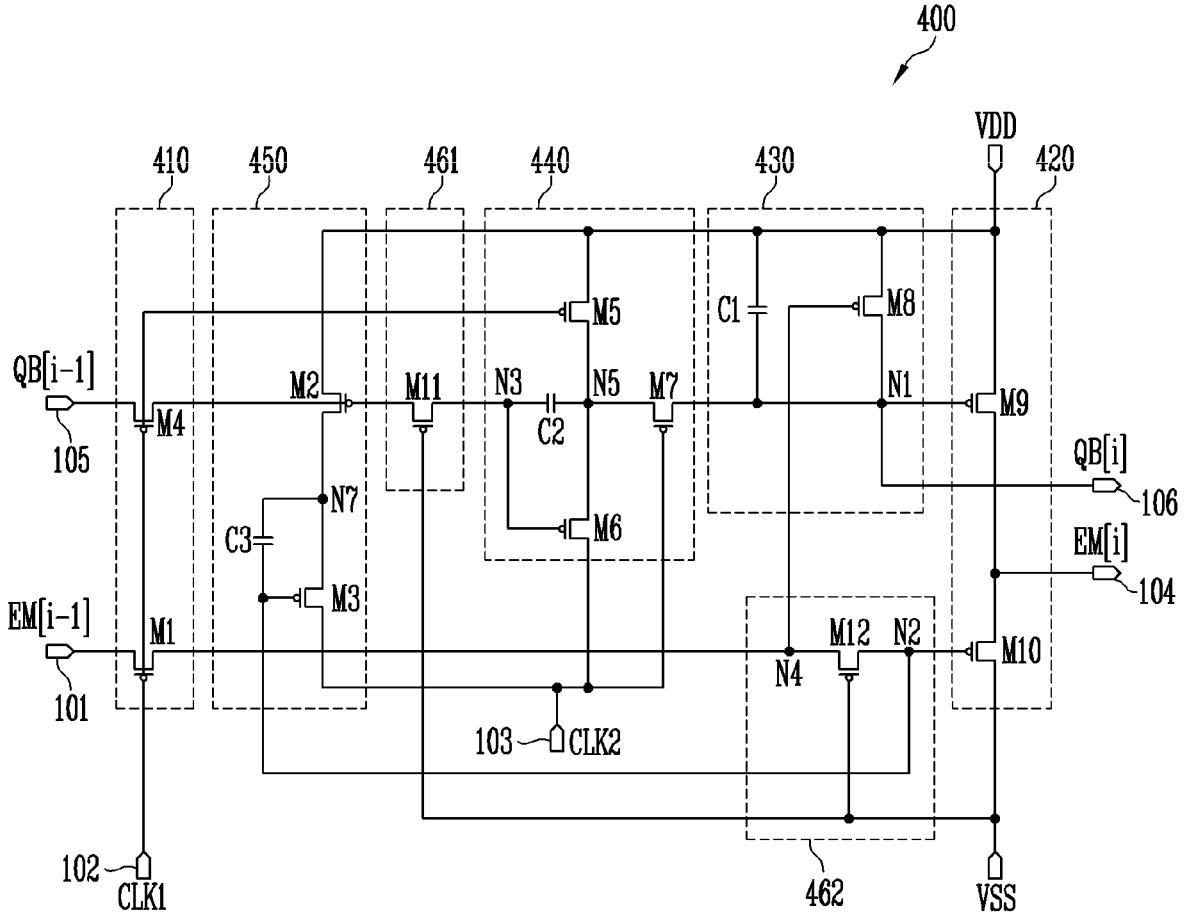
FIG. 3 is a circuit diagram illustrating a stage illustrated in FIG. 2 in accordance with a first embodiment of the present disclosure.

FIG. 3 is a circuit diagram illustrating a stage illustrated in FIG. 2 in accordance with a first embodiment of the present disclosure. Although FIG. 3 illustrates only an i-th stage for the sake of explanation, the stages illustrated in FIG. 2 may have the same structure as that of the i-th stage to be described below.

Referring to FIG. 3, a stage 400 in accordance with the first embodiment of the present disclosure may include an input unit 410, an output unit 420, a first signal processing unit 430, a second signal processing unit 440, a third signal processing unit 450, and first and second stabilization units 461 and 462.

The output unit 420 may supply the voltage of a first power supply VDD or a second power supply VSS to a first output terminal 104 depending on voltages of a first node N1 and a second node N2. To this end, the output unit 420 may include a ninth transistor M9 and a tenth transistor M10.

The ninth transistor M9 is coupled between the first power supply VDD and the first output terminal 104. A gate electrode of the ninth transistor M9 may be coupled to the first node N1. The ninth transistor M9 may be turned on or off depending on the voltage of the first node N1. Here, the voltage of the first power supply VDD that is supplied to the first output terminal 104 when the ninth transistor M9 is turned on may be used as an emission control signal EM[i] of an i-th emission control line Ei.

The tenth transistor M10 is coupled between the first output terminal 104 and the second power supply VSS. A gate electrode of the tenth transistor M10 is coupled to the second node N2. The tenth transistor M10 may be turned on or off depending on the voltage of the second node N2.

The input unit 410 may control the voltages of the second node N2, a third node N3, and a fourth node N4 in response to signals supplied to a first input terminal 101, a second input terminal 102, and a fourth input terminal 105. To this end, the input unit 410 may include a first transistor M1 and a fourth transistor M4.

The first transistor M1 is coupled between the first input terminal 101 and the fourth node N4. A gate electrode of the first transistor M1 is coupled to the second input terminal 102. When the first clock signal CLK1 is supplied to the second input terminal 102, the first transistor M1 may be turned on to electrically couple the first input terminal 101 with the fourth node N4.

A first electrode of the fourth transistor M4 is coupled to the fourth input terminal 105, and a second electrode thereof is coupled to the third node N3 via an eleventh transistor M11. A gate electrode of the fourth transistor M4 is coupled to the second input terminal 102. When the first clock signal CLK1 is supplied to the second input terminal 102, the fourth transistor M4 may be turned on to electrically couple the fourth input terminal 105 with the third node N3.

The first signal processing unit 430 may control the voltage of the first node N1 in response to a voltage of the fourth node N4. The first signal processing unit 430 may supply the voltage of the first power supply VDD to the second output terminal 106 in response to the voltages of the first node N1 and the fourth node N4. To this end, the first signal processing unit 430 may include an eighth transistor M8 and a first capacitor C1.

The eighth transistor M8 is coupled between the first power supply VDD and the first node N1. A gate electrode of the eighth transistor M8 may be coupled to the fourth node N4. The eighth transistor M8 may be turned on or off depending on the voltage of the fourth node N4. Here, the voltage of the first power supply VDD that is supplied to the second output terminal 106 when the eighth transistor M8 is turned on may be used as a control node signal QB[i].

The first capacitor C1 is coupled between the first power supply VDD and the first node N1. The first capacitor C1 may charge a voltage to be applied to the first node N1. Furthermore, the first capacitor C1 may stably maintain the voltage of the first node N1.

The second signal processing unit 440 is coupled to the third node N3, and may control the voltage of the first node N1 in response to a signal input to the third input terminal 103. To this end, the second signal processing unit 440 may include a seventh transistor M7, a sixth transistor M6, a fifth transistor M5, and a second capacitor C2.

A first terminal of the second capacitor C2 is coupled to the third node N3, and a second terminal thereof is coupled to a fifth node N5.

The seventh transistor M7 is coupled between the fifth node N5 and the first node N1. A gate electrode of the seventh transistor M7 is coupled to the third input terminal 103. When the second clock signal CLK2 is supplied to the third input terminal 103, the seventh transistor M7 may be turned on to electrically couple the fifth node N5 with the first node N1.

The sixth transistor M6 is coupled between the fifth node N5 and the third input terminal 103. A gate electrode of the sixth transistor M6 is coupled to the third node N3. The sixth transistor M6 may be turned on or off depending on the voltage of the third node N3.

The fifth transistor M5 is coupled between the first power supply VDD and the fifth node N5. A gate electrode of the fifth transistor M5 is coupled to the second input terminal 102. The fifth transistor M5 may be turned on or off in response to the first clock signal CLK1 supplied to the second input terminal 102.

The third signal processing unit 450 may control the voltage of the third second N2 in response to the voltage of the first power supply VDD and the signal supplied to the fourth input terminal 105. To this end, the third signal processing unit 450 may include a second transistor M2, a third transistor M3, and a third capacitor C3.

A first electrode of the third capacitor C3 is coupled to a seventh node N7, and a second electrode thereof is coupled to a second node N2.

The second transistor M2 is coupled between the first power supply VDD and the seventh node N7. A gate electrode of the second transistor M2 is coupled to the third node N3. The second transistor M2 may be turned on or off depending on the voltage of the third node N3.

The third transistor M3 is coupled between the seventh node N7 and the third input terminal 103. A gate electrode of the third transistor M3 is coupled to the second node N2. The third transistor M3 may be turned on or off depending on the voltage of the second node N2.

The first stabilization unit 461 is coupled between the second signal processing unit 440 and the third signal processing unit 450. The first stabilization unit 461 may limit a voltage drop width of the third node N3. To this end, the first stabilization unit 461 may include the eleventh transistor M11.

The eleventh transistor M11 is coupled between the fourth input terminal 105 and the third node N3. A gate electrode of the eleventh transistor M11 is coupled to the second power supply VSS. The eleventh transistor M11 may be set to a turned-on state.

The second stabilization unit 462 is coupled between the fourth node N4 and the second node N2. The second stabilization unit 462 may limit a voltage drop width of the second node N2. To this end, the second stabilization unit 462 may include a twelfth transistor M12.

The twelfth transistor M12 is coupled between the second node N2 and the fourth node N4. A gate electrode of the twelfth transistor M12 is coupled to the second power supply VSS. The twelfth transistor M12 may be set to a turned-on state.

Figure 4:
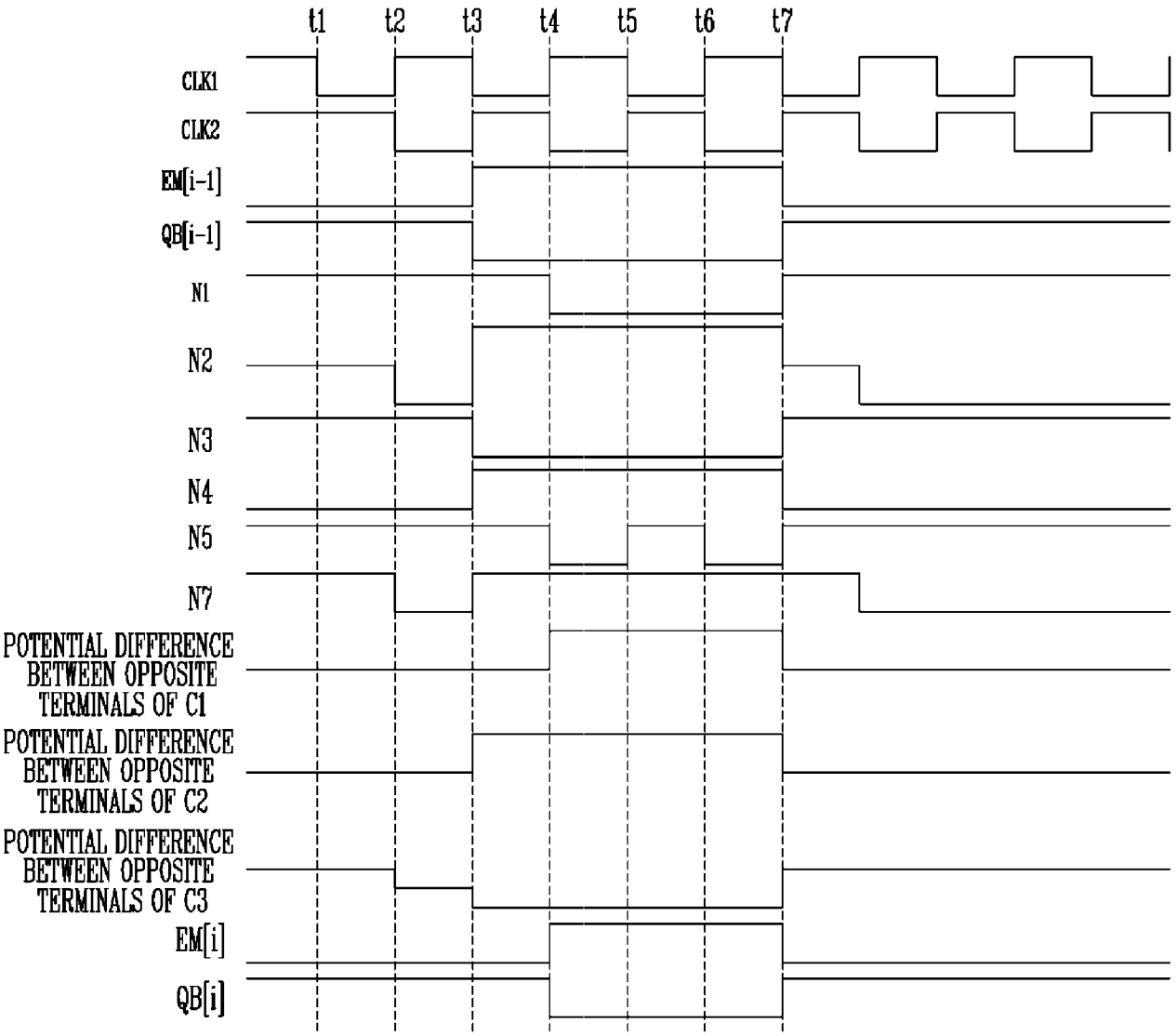
FIG. 4 is a waveform diagram illustrating an operation of the stage illustrated in FIG. 3.

FIG. 4 is a waveform diagram illustrating an operation of the stage illustrated in FIG. 3. For the sake of explanation, FIG. 4 illustrates the operation of only the i-th stage.

Referring to FIG. 4, each of the first clock signal CLK1 and the second clock signal CLK2 may have a cycle of two horizontal periods (2H), and the first clock signal CLK1 and the second clock signal CLK2 may be supplied in different horizontal periods. In other words, the second clock signal CLK2 may be set to a signal shifted by a half cycle (e.g., one horizontal period (1H)) from the first clock signal CLK1.

When the clock signals CLK1 and CLK2 are supplied, the second input terminal 102 and the third input terminal 103 may be set to the voltage of the second power supply VSS. When the clock signals CLK1 and CLK2 are not supplied, the second input terminal 102 and the third input terminal 103 may be set to the voltage of the first power supply VDD.

When the start signal FLM (or the emission control signal EM) is supplied, the first input terminal 101 may be set to the voltage of the first power supply VDD. When the start signal FLM (or the emission control signal EM) is not supplied, the first input terminal 101 may be set to the voltage of the second power supply VSS.

Furthermore, the start signal FLM (or the emission control signal EM) to be supplied to the first input terminal 101 may be set to overlap at least once with the first clock signal CLK1 to be supplied to the second input terminal 102. To this end, the start signal FLM (or the emission control signal EM) may have a width greater than that of the first clock signal CLK1 and, for example, may be supplied during four horizontal periods (4H). In this case, a first emission control signal to be supplied to the first input terminal 101 of the following stage may also overlap at least once with the second clock signal CLK2 to be supplied to the second input terminal 102 of the following stage.

The control node start signal FQB (or the control node signal QB) may have a phase inverted from that of the start signal FLM (or the emission control signal EM). In other words, when the control node start signal FQB (or the control node signal QB) is supplied, the fourth input terminal 105 may be set to the voltage of the second power supply VSS. When the control node start signal FQB (or the control node signal QB) is not supplied, the fourth input terminal 105 may be set to the voltage of the first power supply VDD.

Furthermore, the control node start signal FQB (or the control node signal QB) to be supplied to the fourth input terminal 105 may be set to overlap at least once with the first clock signal CLK1 to be supplied to the second input terminal 102. To this end, the control node start signal FQB (or the control node signal QB) may have a width greater than that of the first clock signal CLK1 and, for example, be supplied during four horizontal periods (4H). In this case, the control node signal QB to be supplied to the fourth input terminal 105 of the following stage may also overlap at least once with the second clock signal CLK2 to be supplied to the second input terminal 102 of the following stage.

Furthermore, the control node start signal FQB (or the control node signal QB) to be supplied to the fourth input terminal 105 may be set to overlap with the emission control signal EM to be supplied to the first input terminal 101.

A process of the operation will be described. First, at a first time t1, the first clock signal CLK1 may be supplied to the second input terminal 102. When the first clock signal CLK1 is supplied to the second input terminal 102, the first transistor M1, the fourth transistor M4, and the fifth transistor M5 may be turned on.

When the fifth transistor M5 is turned on, the voltage of the first power supply VDD may be supplied to the fifth node N5. Thereby, the high voltage may be supplied to the second electrode of the second capacitor C2.

When the first transistor M1 is turned on, the first input terminal 101 and the fourth node N4 may be electrically coupled to each other. Here, because the twelfth transistor M12 remains turned on, the first input terminal 101 may also be electrically coupled with the second node N2 via the fourth node N4. Here, during the first time t1, the emission control signal EM[i−1] (or the start signal FLM) of the preceding stage may not be supplied to the first input terminal 101, so that a low voltage (e.g., VSS) may be supplied to the fourth node N4 and the second node N2. When the low voltage is supplied to the second node N2 and the fourth node N4, the third transistor M3, the eighth transistor M8, and the tenth transistor M10 may be turned on.

When the third transistor M3 is turned on, the third input terminal 103 and the seventh node N7 may be electrically coupled to each other. Because the second clock signal CLK2 is not supplied to the third input terminal 103 at the first time t1, the high voltage may be supplied to the seventh node N7. However, the third capacitor C3 may charge a voltage corresponding to the turned-on state of the third transistor M3.

When the eighth transistor M8 is turned on, the voltage of the first power supply VDD may be supplied to the first node N1. Hence, the ninth transistor M9 may be turned off. As the high voltage is supplied to the first node N1, the high voltage may be supplied to a second electrode of the first capacitor C1. Because a first electrode of the first capacitor C1 is coupled with the first power supply VDD and thus has a high voltage, a potential difference between the opposite electrodes of the first capacitor C1 may have a low level (e.g., may be small or minimal).

When the eighth transistor M8 is turned on, the voltage of the first power supply VDD may be supplied to the second output terminal 106. Hence, at the first time t1, the control node signal QB[i] is not supplied to the second output terminal 106.

When the tenth transistor M10 is turned on, the voltage of the second power supply VSS may be supplied to the first output terminal 104. Therefore, during the first time t1, the emission control signal EM[i] may not be supplied to the emission control line Ei.

When the fourth transistor M4 is turned on, the control node signal QB[i−1] (or the control node start signal FQB) of the preceding stage that is supplied to the fourth input terminal 105 may be supplied to the third node N3 via the eleventh transistor M11 that remains turned on. During the first time t1, the control node signal QB[i−1] of the preceding stage may not be supplied to the fourth input terminal 105, so that the high voltage may be supplied to the third node N3. When the high voltage is supplied to the third node N3, the second transistor M2 and the sixth transistor M6 may be turned off. Furthermore, the high voltage may be supplied to a first electrode of the second capacitor C2 coupled to the third node N3. Because the high voltage is supplied to the second electrode of the second capacitor C2, a potential difference between the opposite electrodes of the second capacitor C2 may have a low level.

At a second time t2, the supply of the first clock signal CLK1 to the second input terminal 102 may be interrupted. When the supply of the first clock signal CLK1 is interrupted, the first transistor M1, the fourth transistor M4, and the fifth transistor M5 may be turned off. Here, the first node N1 and the second node N2 may respectively maintain the voltages of the preceding period due to the first capacitor C1 and the third capacitor C3 (e.g., due to the respective potential difference between opposite terminals of the first and third capacitors C1 and C3 remaining constant). Because the first node N1 remains in the high voltage state, the ninth transistor M9 may remain turned off. Because the second node N2 remains in the low voltage state, the third transistor M3, the eighth transistor M8, and the tenth transistor M10 may remain turned on.

At the second time t2, the second clock signal CLK2 may be supplied to the third input terminal 103. When the second clock signal CLK2 is supplied to the third input terminal 103, the seventh transistor M7 may be turned on.

When the seventh transistor M7 is turned on, the first node N1 and the fifth node N5 may be electrically coupled to each other. Thereby, the fifth node N5 may remain in the high voltage state, and the potential difference between the opposite electrodes of the second capacitor C2 may be maintained at the low level.

As such, while the emission control signal EM[i] is not supplied to the emission control line Ei, the potential difference between the opposite electrodes of the second capacitor C2 may be stably maintained. Hence, the capacitor C2 may be prevented from being charged or discharged, and the power consumption may be consequently reduced.

At the second time t2, the low-level second clock signal CLK2 may be supplied to the seventh node N7. Therefore, the low voltage is supplied to the seventh node N7. Then, the voltage of the second node N2 may be maintained at a voltage (a 2-step low voltage) that is less than the voltage of the second power supply VSS by coupling of the third capacitor C3.

At a third time t3, the emission control signal EM[i−1] of the preceding stage may be supplied to the first input terminal 101. The first clock signal CLK1 may be supplied to the second input terminal 102. The control node signal QB[i−1] of the preceding stage may be supplied to the fourth input terminal 105. When the first clock signal CLK1 is supplied to the second input terminal 102, the first transistor M1, the fourth transistor M4, and the fifth transistor M5 may be turned on.

When the fifth transistor M5 is turned on, the voltage of the first power supply VDD may be supplied to the fifth node N5. Thereby, the high voltage may be supplied to the second electrode of the second capacitor C2.

When the first transistor M1 is turned on, the first input terminal 101, the fourth node N4, and the second node N2 may be electrically coupled to each other. Then, the fourth node N4 and the second node N2 may be set to the high voltage by the emission control signal EM[i−1] of the preceding stage that is supplied to the first input terminal 101. When the fourth node N4 and the second node N2 are set to the high voltage, the third transistor M3, the eighth transistor M8, and the tenth transistor M10 may be turned off.

When the fourth transistor M4 is turned on, the fourth input terminal 105 and the third node N3 may be electrically coupled to each other. Then, the third node N3 may be set to the low voltage by the control node signal QB[i−1] of the preceding stage that is supplied to the fourth input terminal 105. When the third node N3 is set to the low voltage, the second transistor M2 and the sixth transistor M6 may be turned on. Furthermore, the low voltage may be supplied to the first electrode of the second capacitor C2 coupled to the third node N3. Because the high voltage is supplied to the second electrode of the second capacitor C2, the second capacitor C2 may be charged, and a potential difference between the opposite electrodes of the second capacitor C2 may be set to a high level.

When the second transistor M2 is turned on, the voltage of the first power supply VDD may be supplied to the seventh node N7. Because the high voltage is supplied to a first electrode of the third capacitor C3 that is coupled to the seventh node N7 and the high voltage is supplied to a second electrode of the third capacitor C3 that is coupled to the second node N2, the third capacitor C3 may be discharged, and a potential difference between the opposite electrodes of the third capacitor C3 may be set to a low level.

When the sixth transistor M6 is turned on, the second clock signal CLK2 that is supplied to the third input terminal 103 may be supplied to the fifth node N5. Because the second clock signal CLK2 is not supplied to the third input terminal 103 at the third time t3, the high voltage may be supplied to the fifth node N5.

At a fourth time t4, the second clock signal CLK2 may be supplied to the third input terminal 103. When the second clock signal CLK2 is supplied to the third input terminal 103, the seventh transistor M7 may be turned on.

When the seventh transistor M7 is turned on, the fifth node N5 and the first node N1 may be electrically coupled to each other. Here, the low-level second clock signal CLK2 that is supplied to the third input terminal 103 via the sixth transistor M6 that remains turned on may be supplied to the fifth node N5 and the first node N1. When the low voltage is supplied to the first node N1, the ninth transistor M9 may be turned on.

When the ninth transistor M9 is turned on, the voltage of the first power supply VDD may be supplied to the first output terminal 104. The voltage of the first power supply VDD that is supplied to the first output terminal 104 may be supplied to the i-th emission control line Ei as the emission control signal EM[i].

Because the first node N1 is set to the low voltage, the control node signal QB[i] may be supplied to the second output terminal 106.

At a fifth time t5, the first clock signal CLK1 may be supplied to the second input terminal 102. When the first clock signal CLK1 is supplied to the second input terminal 102, the first transistor M1, the fourth transistor M4, and the fifth transistor M5 may be turned on.

When the fifth transistor M5 is turned on, the voltage of the first power supply VDD may be supplied to the fifth node N5. Thereby, the high voltage may be supplied to the second electrode of the second capacitor C2.

When the first transistor M1 is turned on, the first input terminal 101, the fourth node N4, and the second node N2 may be electrically coupled to each other. Then, the fourth node N4 and the second node N2 may remain in the high voltage state by the emission control signal EM[i−1] of the preceding stage that is supplied to the first input terminal 101.

When the fourth transistor M4 is turned on, the fourth input terminal 105 and the third node N3 may be electrically coupled to each other. Then, the third node N3 may remain in the low voltage state by the control node signal QB[i−1] of the preceding stage that is supplied to the fourth input terminal 105. Furthermore, the first electrode of the second capacitor C2 coupled to the third node N3 may remain in the low voltage state. Because the high voltage is supplied to the second electrode of the second capacitor C2, the second capacitor C2 may be charged, and the potential difference between the opposite electrodes of the second capacitor C2 may be maintained at the high level.

When the second transistor M2 is turned on, the voltage of the first power supply VDD may be supplied to the seventh node N7. Because the high voltage is supplied to the first electrode of the third capacitor C3 that is coupled to the seventh node N7 and the high voltage is supplied to the second electrode of the third capacitor C3 that is coupled to the second node N2, the third capacitor C3 may be discharged, and the potential difference between the opposite electrodes of the third capacitor C3 may be maintained at the low level.

When the sixth transistor M6 is turned on, the second clock signal CLK2 that is supplied to the third input terminal 103 may be supplied to the fifth node N5. Because the second clock signal CLK2 is not supplied to the third input terminal 103 at the fifth time t5, the high voltage may be supplied to the fifth node N5.

Because the ninth transistor M9 remains turned on at the fifth time t5, the emission control signal EM[i] may remain in the supply state.

The operation at a sixth time t6 is the same as that at the fourth time t4; therefore, a repeated detailed description thereof will be omitted. During the sixth time t6, the emission control signal EM[i] may remain in the supply state.

The operation after a seventh time t7 is the same as that at the first time t1 and the second time t2. After the seventh time t7, the supply of the emission control signal EM[i−1] (or the start signal FLM) of the preceding stage and the control node signal QB[i−1] (or the control node start signal FQB) of the preceding stage is interrupted. Therefore, the emission control signal EM[i] may not be output. While the emission control signal EM[i] is not supplied after the seventh time t7, as shown in the description of the operation pertaining to the first time t1 and the second time t2, the potential difference between the opposite electrodes of the second capacitor C2 may be maintained at the low level, and the potential difference between the opposite electrodes of the third capacitor C3 may be maintained at the high level.

In other words, in the present disclosure, while the emission control signal EM[i] is disabled, the second capacitor C2 and the third capacitor C3 may be neither charged nor discharged. Therefore, the power consumption of the display device may be reduced.

Figure 5:
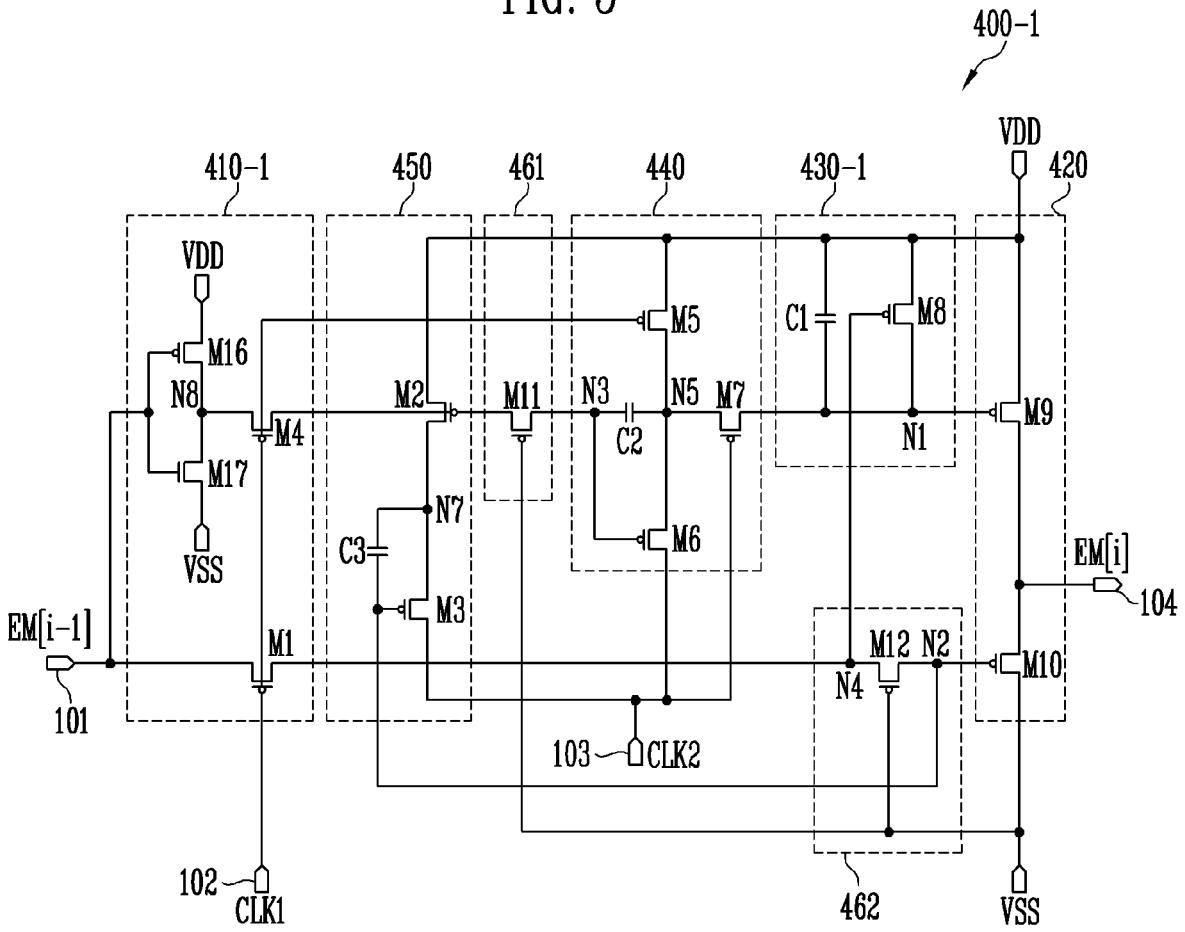
FIG. 5 is a circuit diagram illustrating a stage illustrated in FIG. 2 in accordance with a second embodiment of the present disclosure.

FIG. 5 is a circuit diagram illustrating a stage illustrated in FIG. 2 in accordance with a second embodiment of the present disclosure. In FIG. 5, the same reference numerals are used to designate the same components as those of FIG. 3, and a repeated detailed description thereof will be omitted.

Referring to FIG. 5, the stage 400-1 in accordance with the second embodiment of the present disclosure may include an input unit 410-1, an output unit 420-1, a first signal processing unit 430-1, a second signal processing unit 440, a third signal processing unit 450, and first and second stabilization units 461 and 462.

The input unit 410-1 may control the voltages of a third node N3 and a fourth node N4 in response to signals supplied to a first input terminal 101 and a second input terminal 102. To this end, the input unit 410-1 may include a first transistor M1, a fourth transistor M4, a sixteenth transistor M16, and a seventeenth transistor M17.

The first transistor M1 is coupled between the first input terminal 101 and the fourth node N4. A gate electrode of the first transistor M1 is coupled to the second input terminal 102. When the first clock signal CLK1 is supplied to the second input terminal 102, the first transistor M1 may be turned on to electrically couple the first input terminal 101 with the fourth node N4.

A first electrode of the fourth transistor M4 is coupled to an eighth node N8, and a second electrode thereof is coupled to the third node N3 via an eleventh transistor M11. A gate electrode of the fourth transistor M4 is coupled to the second input terminal 102. When the first clock signal CLK1 is supplied to the second input terminal 102, the fourth transistor M4 may be turned on to electrically couple the eighth node N8 with the third node N3.

The sixteenth transistor M16 is coupled between a first power supply VDD and the eighth node N8. A gate electrode of the sixteenth transistor M16 is coupled to the first input terminal 101. The sixteenth transistor M16 may be formed of a P-type transistor. When a low voltage is supplied to the first input terminal 101, the sixteenth transistor M16 may be turned on so that a high voltage may be supplied to the eighth node N8.

The seventeenth transistor M17 is coupled between the eighth node N8 and the second power supply VSS. A gate electrode of the seventeenth transistor M17 is coupled to the first input terminal 101. The seventeenth transistor M17 may be formed of an N-type transistor. When a high voltage is supplied to the first input terminal 101, the seventeenth transistor M17 may be turned on so that a low voltage may be supplied to the eighth node N8.

The first signal processing unit 430-1 may control the voltage of the first node N1 in response to a voltage of the fourth node N4. The first signal processing unit 430-1 may supply the voltage of the first power supply VDD to the first node N1 in response to the voltage of the fourth node N4. To this end, the first signal processing unit 430-1 may include an eighth transistor M8 and a first capacitor C1.

The eighth transistor M8 is coupled between the first power supply VDD and the first node N1. A gate electrode of the eighth transistor M8 may be coupled to the fourth node N4. The eighth transistor M8 may be turned on or off depending on the voltage of the fourth node N4.

The first capacitor C1 is coupled between the first power supply VDD and the first node N1. The first capacitor C1 may charge a voltage to be applied to the first node N1. Furthermore, the first capacitor C1 may stably maintain the voltage of the first node N1.

In the second embodiment of the present disclosure, the emission control signal EM[i−1] of the preceding stage may be inverted using the sixteenth transistor M16 and the seventeenth transistor M17 that are formed of inverters (e.g., that collectively form an inverter), and then supplied to the third node N3. In this case, the stage 400-1 according to the second embodiment has the same configuration as that of FIG. 3 except that the control node signal QB[i−1] of the preceding stage is replaced with the emission control signal EM[i−1] of the preceding stage (e.g., the fourth input terminal is effectively the same as, or is coupled to, the first input terminal 101). Therefore, detailed description of the process of the operation will be omitted.

Figure 6:
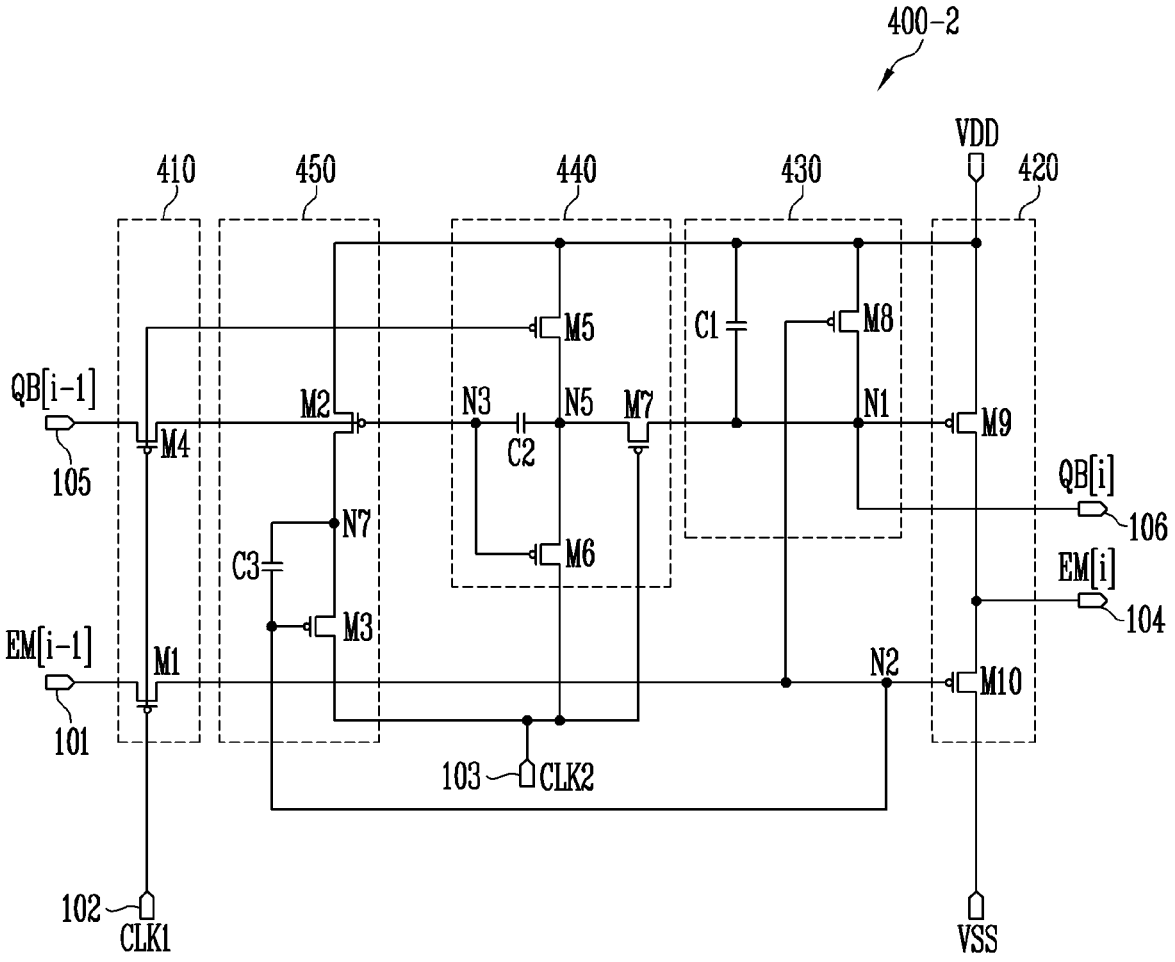
FIG. 6 is a circuit diagram illustrating a stage illustrated in FIG. 2 in accordance with a third embodiment of the present disclosure.

FIG. 6 is a circuit diagram illustrating a stage illustrated in FIG. 2 in accordance with a third embodiment of the present disclosure. In FIG. 6, the same reference numerals are used to designate the same components as those of FIG. 3, and a repeated detailed description thereof will be omitted.

Referring to FIG. 6, a stage 400-2 in accordance with the third embodiment of the present disclosure may include an input unit 410, an output unit 420, a first signal processing unit 430, a second signal processing unit 440, and a third signal processing unit 450.

The stage 400-2 according to the third embodiment, except that the first and second stabilization units 461 and 462 are omitted, has the same configuration as that of FIG. 3. Therefore, detailed description of the process of the operation will be omitted.

Figure 7:
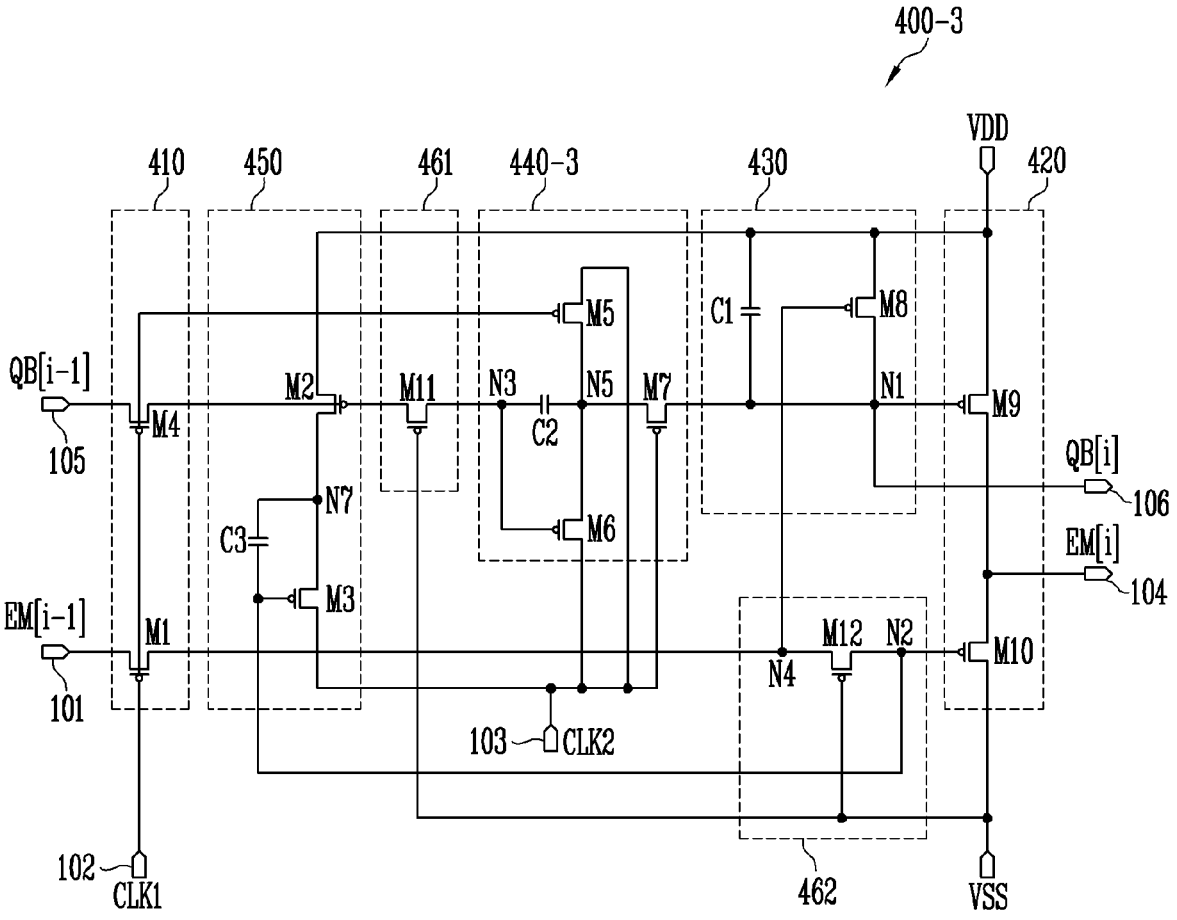
FIG. 7 is a circuit diagram illustrating a stage illustrated in FIG. 2 in accordance with a fourth embodiment of the present disclosure.

FIG. 7 is a circuit diagram illustrating a stage illustrated in FIG. 2 in accordance with a fourth embodiment of the present disclosure. In FIG. 7, the same reference numerals are used to designate the same components as those of FIG. 3, and a repeated detailed description thereof will be omitted.

Referring to FIG. 7, the stage 400-3 in accordance with the fourth embodiment of the present disclosure may include an input unit 410, an output unit 420, a first signal processing unit 430, a second signal processing unit 440-3, a third signal processing unit 450, and first and second stabilization units 461 and 462.

The second signal processing unit 440-3 is coupled to a third node N3, and may control the voltage of a first node N1 in response to a signal input to a third input terminal 103. To this end, the second signal processing unit 440-3 may include a seventh transistor M7, a sixth transistor M6, a fifth transistor M5, and a second capacitor C2.

A first terminal of the second capacitor C2 is coupled to the third node N3, and a second terminal thereof is coupled to a fifth node N5.

The seventh transistor M7 is coupled between the fifth node N5 and the first node N1. A gate electrode of the seventh transistor M7 is coupled to the third input terminal 103. When the second clock signal CLK2 is supplied to the third input terminal 103, the seventh transistor M7 may be turned on to electrically couple the fifth node N5 with the first node N1.

The sixth transistor M6 is coupled between the fifth node N5 and the third input terminal 103. A gate electrode of the sixth transistor M6 is coupled to the third node N3. The sixth transistor M6 may be turned on or off depending on the voltage of the third node N3.

The fifth transistor M5 is coupled between the third input terminal 103 and the fifth node N5. A gate electrode of the fifth transistor M5 is coupled to the second input terminal 102. The fifth transistor M5 may be turned on or off in response to the first clock signal CLK1 supplied to the second input terminal 102.

The stage 400-3 according to the fourth embodiment, except that the fifth transistor M5 of the second signal processing unit 440-3 is coupled to the third input terminal 103 rather than the first power supply VDD, has the same configuration as that of FIG. 3. Therefore, detailed description of the process of the operation will be omitted.

Figure 8:
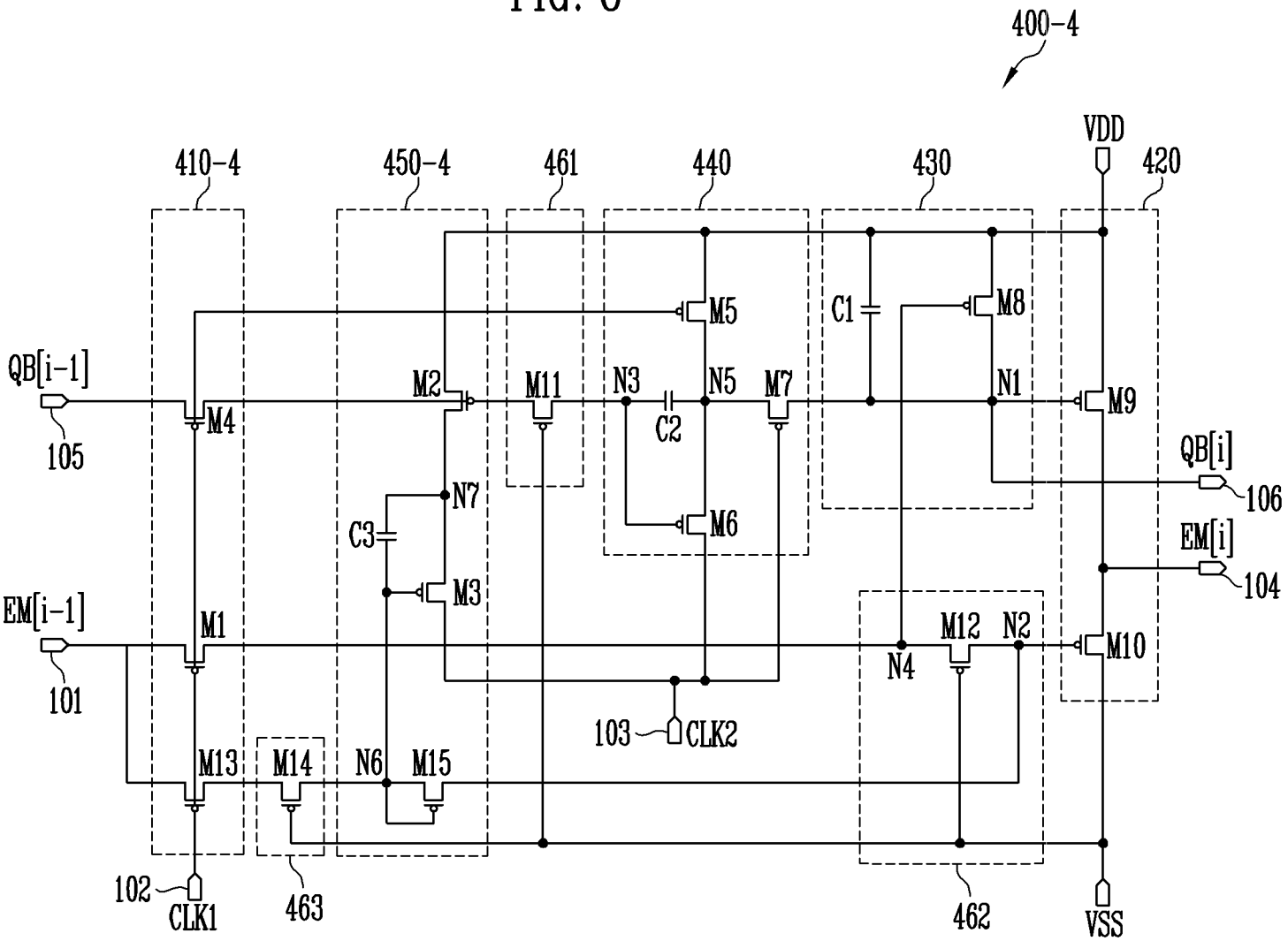
FIG. 8 is a circuit diagram illustrating a stage illustrated in FIG. 2 in accordance with a fifth embodiment of the present disclosure.

FIG. 8 is a circuit diagram illustrating a stage illustrated in FIG. 2 in accordance with a fifth embodiment of the present disclosure. Although FIG. 8 illustrates only an i-th stage for the sake of explanation, the stages illustrated in FIG. 2 may have the same structure as that of the i-th stage to be described below.

Referring to FIG. 8, the stage 400-4 in accordance with the fifth embodiment of the present disclosure may include an input unit 410-4, an output unit 420, a first signal processing unit 430, a second signal processing unit 440, a third signal processing unit 450-4, and first to third stabilization units 461, 462, and 463.

The output unit 420 may supply the voltage of a first power supply VDD or a second power supply VSS to a first output terminal 104 depending on voltages of a first node N1 and a second node N2. To this end, the output unit 420 may include a ninth transistor M9 and a tenth transistor M10.

The ninth transistor M9 is coupled between the first power supply VDD and the first output terminal 104. A gate electrode of the ninth transistor M9 may be coupled to the first node N1. The ninth transistor M9 may be turned on or off depending on the voltage of the first node N1. Here, the voltage of the first power supply VDD that is supplied to the first output terminal 104 when the ninth transistor M9 is turned on may be used as an emission control signal EM[i] of an i-th emission control line Ei.

The tenth transistor M10 is coupled between the first output terminal 104 and the second power supply VSS. A gate electrode of the tenth transistor M10 is coupled to the second node N2. The tenth transistor M10 may be turned on or off depending on the voltage of the second node N2.

The input unit 410-4 may control the voltages of a third node N3 and a fourth node N4 in response to signals supplied to a first input terminal 101, a second input terminal 102, and a fourth input terminal 105. To this end, the input unit 410-4 may include a first transistor M1, a fourth transistor M4, and a thirteenth transistor M13.

The first transistor M1 is coupled between the first input terminal 101 and the fourth node N4. A gate electrode of the first transistor M1 is coupled to the second input terminal 102. When the first clock signal CLK1 is supplied to the second input terminal 102, the first transistor M1 may be turned on to electrically couple the first input terminal 101 with the fourth node N4.

A first electrode of the fourth transistor M4 is coupled to the fourth input terminal 105, and a second electrode thereof is coupled to the third node N3 via an eleventh transistor M11. A gate electrode of the fourth transistor M4 is coupled to the second input terminal 102. When the first clock signal CLK1 is supplied to the second input terminal 102, the fourth transistor M4 may be turned on to electrically couple the fourth input terminal 105 with the third node N3.

A first electrode of the thirteenth transistor M13 is coupled to the first input terminal 101, and a second electrode thereof is coupled to a sixth node N6 via a fourteenth transistor M14. A gate electrode of the thirteenth transistor M13 is coupled to the second input terminal 102. When the first clock signal CLK1 is supplied to the second input terminal 102, the thirteenth transistor M13 may be turned on to electrically couple the first input terminal 101 with the sixth node N6.

The first signal processing unit 430 may control the voltage of the first node N1 in response to a voltage of the fourth node N4. The first signal processing unit 430 may supply the voltage of the first power supply VDD to the second output terminal 106 in response to the voltages of the first node N1 and the fourth node N4. To this end, the first signal processing unit 430 may include an eighth transistor M8 and a first capacitor C1.

The eighth transistor M8 is coupled between the first power supply VDD and the first node N1. A gate electrode of the eighth transistor M8 may be coupled to the fourth node N4. The eighth transistor M8 may be turned on or off depending on the voltage of the fourth node N4. Here, the voltage of the first power supply VDD that is supplied to the second output terminal 106 when the eighth transistor M8 is turned on may be used as a control node signal QB[i].

The first capacitor C1 is coupled between the first power supply VDD and the first node N1. The first capacitor C1 may charge a voltage to be applied to the first node N1. Furthermore, the first capacitor C1 may stably maintain the voltage of the first node N1.

The second signal processing unit 440 is coupled to the third node N3, and may control the voltage of the first node N1 in response to a signal input to the third input terminal 103. To this end, the second signal processing unit 440 may include a seventh transistor M7, a sixth transistor M6, a fifth transistor M5, and a second capacitor C2.

A first terminal of the second capacitor C2 is coupled to the third node N3, and a second terminal thereof is coupled to a fifth node N5.

The seventh transistor M7 is coupled between the fifth node N5 and the first node N1. A gate electrode of the seventh transistor M7 is coupled to the third input terminal 103. When the second clock signal CLK2 is supplied to the third input terminal 103, the seventh transistor M7 may be turned on to electrically couple the fifth node N5 with the first node N1.

The sixth transistor M6 is coupled between the fifth node N5 and the third input terminal 103. A gate electrode of the sixth transistor M6 is coupled to the third node N3. The sixth transistor M6 may be turned on or off depending on the voltage of the third node N3.

The fifth transistor M5 is coupled between the first power supply VDD and the fifth node N5. A gate electrode of the fifth transistor M5 is coupled to the second input terminal 102. The fifth transistor M5 may be turned on or off in response to the first clock signal CLK1 supplied to the second input terminal 102.

The third signal processing unit 450-4 may control the voltage of the sixth node N6 in response to the voltage of the third node N3 and a signal input to the third input terminal 103. To this end, the third signal processing unit 450-4 may include a second transistor M2, a third transistor M3, a fifteenth transistor M15, and a third capacitor C3.

A first electrode of the third capacitor C3 is coupled to a seventh node N7, and a second electrode thereof is coupled to the sixth node N6.

The second transistor M2 is coupled between the first power supply VDD and the seventh node N7. A gate electrode of the second transistor M2 is coupled to the third node N3. The second transistor M2 may be turned on or off depending on the voltage of the third node N3.

The third transistor M3 is coupled between the seventh node N7 and the third input terminal 103. A gate electrode of the third transistor M3 is coupled to the sixth node N6. The third transistor M3 may be turned on or off depending on the voltage of the second node N2.

The fifteenth transistor M15 is coupled between the sixth node N6 and the second node N2. A gate electrode of the fifteenth transistor M15 is coupled to the sixth node N6. The fifteenth transistor M15 is connected in the form of a diode to allow current to flow from the second node N2 to the sixth node N6.

The first stabilization unit 461 is coupled between the second signal processing unit 440 and the third signal processing unit 450-4. The first stabilization unit 461 may limit a voltage drop width of the third node N3. To this end, the first stabilization unit 461 may include the eleventh transistor M11.

The eleventh transistor M11 is coupled between the fourth input terminal 105 and the third node N3. A gate electrode of the eleventh transistor M11 is coupled to the second power supply VSS. The eleventh transistor M11 may be set to a turned-on state.

The second stabilization unit 462 is coupled between the fourth node N4 and the second node N2. The second stabilization unit 462 may limit a voltage drop width of the fourth node N4. To this end, the second stabilization unit 462 may include a twelfth transistor M12.

The twelfth transistor M12 is coupled between the second node N2 and the fourth node N4. A gate electrode of the twelfth transistor M12 is coupled to the second power supply VSS. The twelfth transistor M12 may be set to a turned-on state.

The third stabilization unit 463 is coupled between the input unit 410-4 and the third signal processing unit 450-4. The third stabilization unit 463 may limit a voltage drop width of the sixth node N6. To this end, the first stabilization unit 463 may include the fourteenth transistor M14.

The fourteenth transistor M14 is coupled between the thirteenth transistor M13 and the sixth node N6. A gate electrode of the fourteenth transistor M14 is coupled to the second power supply VSS. The fourteenth transistor M14 may be set to a turned-on state.

Figure 9:
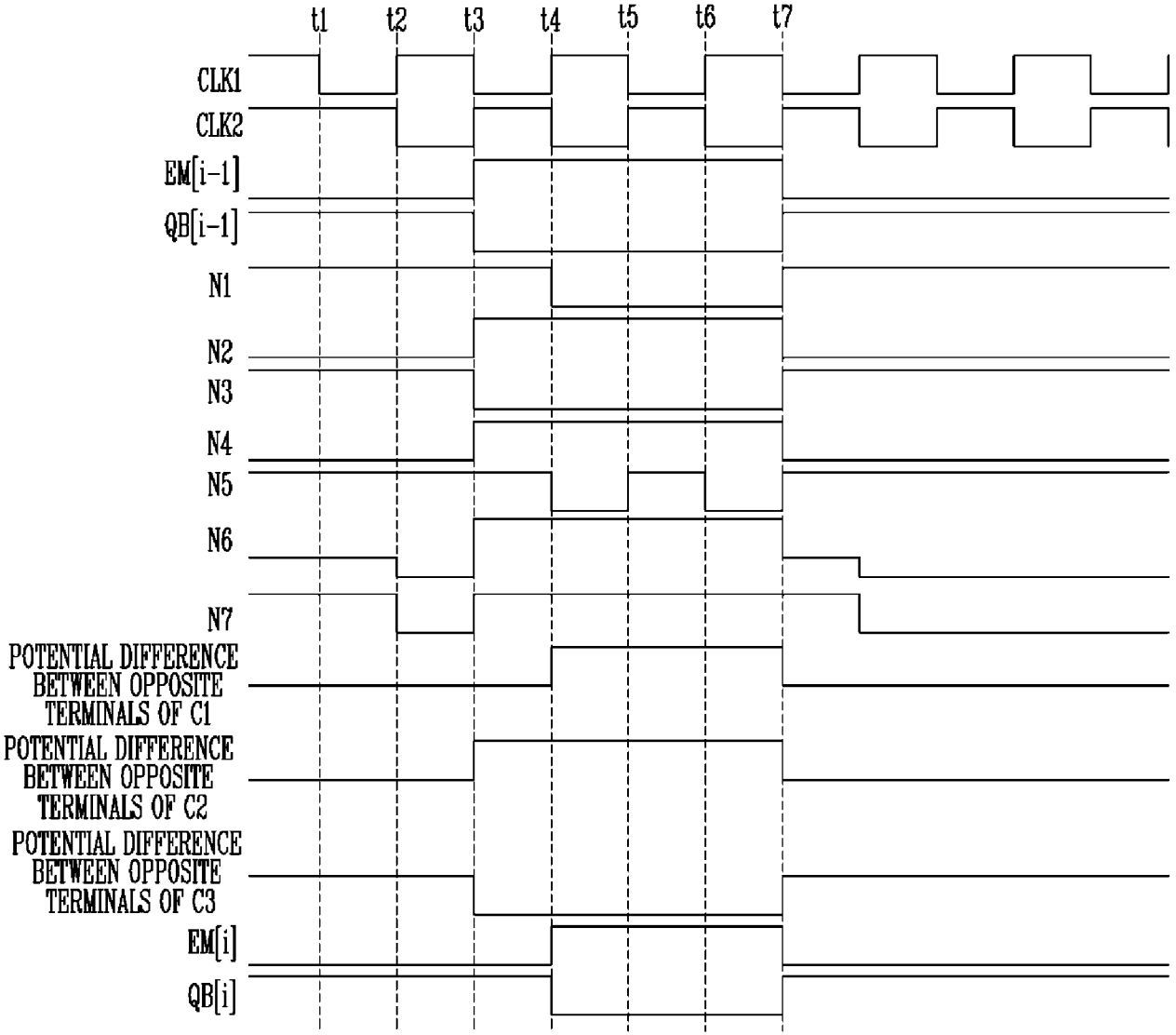
FIG. 9 is a waveform diagram illustrating an operation of the stage illustrated in FIG. 8.

FIG. 9 is a waveform diagram illustrating an operation of the stage illustrated in FIG. 8. For the sake of explanation, FIG. 9 illustrates the operation of only the i-th stage.

Referring to FIG. 9, each of the first clock signal CLK1 and the second clock signal CLK2 may have a cycle of two horizontal periods (2H), and the first clock signal CLK1 and the second clock signal CLK2 may be supplied in different horizontal periods. In other words, the second clock signal CLK2 may be set to a signal shifted by a half cycle (e.g., one horizontal period (1H)) from the first clock signal CLK1.

When the clock signals CLK1 and CLK2 are supplied, the second input terminal 102 and the third input terminal 103 may be set to the voltage of the second power supply VSS. When the clock signals CLK1 and CLK2 are not supplied, the second input terminal 102 and the third input terminal 103 may be set to the voltage of the first power supply VDD.

When the start signal FLM (or the emission control signal EM[i−1] of the preceding stage) is supplied, the first input terminal 101 may be set to the voltage of the first power supply VDD. When the start signal FLM (or the emission control signal EM[i−1] of the preceding stage) is not supplied, the first input terminal 101 may be set to the voltage of the second power supply VSS.

Furthermore, the start signal FLM (or the emission control signal EM[i−1] of the preceding stage) to be supplied to the first input terminal 101 may be set to overlap at least once with the first clock signal CLK1 to be supplied to the second input terminal 102. To this end, the start signal FLM (or the emission control signal EM) may have a width that is greater than that of the first clock signal CLK1 and, for example, may be supplied during four horizontal periods (4H). In this case, a first emission control signal to be supplied to the first input terminal 101 of the following stage may also overlap at least once with the second clock signal CLK2 to be supplied to the second input terminal 102 of the following stage.

The control node start signal FQB (or the control node signal QB) may have a phase that is inverted from that of the start signal FLM (or the emission control signal EM). In other words, when the control node start signal FQB (or the control node signal QB[i−1] of the preceding stage) is supplied, the fourth input terminal 105 may be set to the voltage of the second power supply VSS. When the control node start signal FQB (or the control node signal QB[i−1] of the preceding stage) is not supplied, the fourth input terminal 105 may be set to the voltage of the first power supply VDD.

Furthermore, the control node start signal FQB (or the control node signal QB[i−1] of the preceding stage) to be supplied to the fourth input terminal 105 may be set to overlap at least once with the first clock signal CLK1 to be supplied to the second input terminal 102. To this end, the control node start signal FQB (or the control node signal QB) may have a width greater than that of the first clock signal CLK1 and, for example, be supplied during four horizontal periods (4H). In this case, the control node signal QB to be supplied to the fourth input terminal 105 of the following stage may also overlap at least once with the second clock signal CLK2 to be supplied to the second input terminal 102 of the following stage.

Furthermore, the control node start signal FQB (or the control node signal QB[i−1] of the preceding stage) to be supplied to the fourth input terminal 105 may be set to overlap with the start signal FLM (or the emission control signal EM[i−1] of the preceding stage) to be supplied to the first input terminal 101.

A process of the operation will be described. First, at a first time t1, the first clock signal CLK1 may be supplied to the second input terminal 102. When the first clock signal CLK1 is supplied to the second input terminal 102, the first transistor M1, the fourth transistor M4, the fifth transistor M5, and the thirteenth transistor M13 may be turned on.

When the fifth transistor M5 is turned on, the voltage of the first power supply VDD may be supplied to the fifth node N5. Thereby, the high voltage may be supplied to the second electrode of the second capacitor C2.

When the first transistor M1 is turned on, the first input terminal 101 and the fourth node N4 may be electrically coupled to each other. Here, because the twelfth transistor M12 remains turned on, the first input terminal 101 may also be electrically coupled with the second node N2 via the fourth node N4. Here, at the first time t1, the emission control signal EM[i−1] (or the start signal FLM) of the preceding stage may not be supplied to the first input terminal 101, so that a low voltage (e.g., VSS) may be supplied to the fourth node N4 and the second node N2. When the low voltage is supplied to the fourth node N4, the eighth transistor M8 and the tenth transistor M10 may be turned on.

When the eighth transistor M8 is turned on, the voltage of the first power supply VDD may be supplied to the first node N1. Hence, the ninth transistor M9 may be turned off. As the high voltage is supplied to the first node N1, the high voltage may be supplied to the second electrode of the first capacitor C1. Because a first electrode of the first capacitor C1 is coupled with the first power supply VDD and thus has a high voltage, a potential difference between the opposite electrodes of the first capacitor C1 may have a low level/may be low.

When the eighth transistor M8 is turned on, the voltage of the first power supply VDD may be supplied to the second output terminal 106. Hence, at the first time t1, the control node signal QB[i] is not supplied to the second output terminal 106.

When the tenth transistor M10 is turned on, the voltage of the second power supply VSS may be supplied to the first output terminal 104. Therefore, during the first time t1, the emission control signal EM[i] may not be supplied to the emission control line Ei.

When the fourth transistor M4 is turned on, the control node signal QB[i−1] (or the control node start signal FQB) of the preceding stage that is supplied to the fourth input terminal 105 may be supplied to the third node N3 via the eleventh transistor M11 that remains turned on. Here, during the first time t1, the control node signal QB[i−1] of the preceding stage may not be supplied to the fourth input terminal 105, so that the high voltage may be supplied to the third node N3. When the high voltage is supplied to the third node N3, the second transistor M2 and the sixth transistor M6 may be turned off. Furthermore, the high voltage may be supplied to a first electrode of the second capacitor C2 coupled to the third node N3. Because the high voltage is supplied to the second electrode of the second capacitor C2, a potential difference between the opposite electrodes of the second capacitor C2 may have a low level.

When the thirteenth transistor M13 is turned on, the first input terminal 101 is electrically coupled with the sixth node N6 via the fourteenth transistor M14 that remains turned on. Here, at the first time t1, the emission control signal EM[i−1] of the preceding stage may not be supplied to the first input terminal 101, so that the low voltage may be supplied to the sixth node N6. When the low voltage is supplied to the sixth node N6, the third transistor M3 and the fifteenth transistor M15 may be turned on.

The fifteenth transistor M15 is coupled in the form of a diode between the sixth node N6 and the second node N2.

When the third transistor M3 is turned on, the third input terminal 103 and the seventh node N7 may be electrically coupled to each other. Because the second clock signal CLK2 is not supplied to the third input terminal 103 at the first time t1, the high voltage may be supplied to the seventh node N7. Because the high voltage is supplied to the first electrode of the third capacitor C3 coupled to the seventh node N7 and the low voltage is supplied to the second electrode thereof, a potential difference between the opposite electrodes of the third capacitor C3 may have a high level. Here, the voltage of the second node N2 may be maintained at a voltage (a 2-step low voltage) that is less than the low-level voltage by coupling of the third capacitor C3.

At a second time t2, the supply of the first clock signal CLK1 to the second input terminal 102 may be interrupted. When the supply of the first clock signal CLK1 is interrupted, the first transistor M1, the fourth transistor M4, the fifth transistor M5, and the thirteenth transistor M13 may be turned off. Here, the first node N1 and the second node N2 may maintain the voltages of the preceding period by the first capacitor C1 and the third capacitor C3. Because the first node N1 remains in the high voltage state, the ninth transistor M9 may remain turned off. Because the second node N2 remains in the low voltage state, the third transistor M3, the eighth transistor M8, and the tenth transistor M10 may remain turned on.

At the second time t2, the second clock signal CLK2 may be supplied to the third input terminal 103. When the second clock signal CLK2 is supplied to the third input terminal 103, the seventh transistor M7 may be turned on.

When the seventh transistor M7 is turned on, the first node N1 and the fifth node N5 may be electrically coupled to each other. Thereby, the fifth node N5 may remain in the high voltage state, and a potential difference between the opposite electrodes of the second capacitor C2 may be maintained at the low level.

At the second time t2, the low-level second clock signal CLK2 may be supplied to the seventh node N7. Therefore, a low-level voltage is supplied to the seventh node N7. Here, the voltage of the sixth node N6 may be set to a voltage (two step low voltage) that is less than the low voltage by the fifteenth transistor M15 connected in the form of a diode, and a potential difference between the opposite electrodes of the third capacitor C3 may be maintained at the high level.

As such, while the emission control signal EM[i] is not supplied to the emission control line Ei, the potential difference between the opposite electrodes of each of the second capacitor C2 and the third capacitor C3 may be stably maintained. Hence, the capacitor C2 and the third capacitor C3 may be prevented from being charged or discharged (e.g., may have a degree of charging or discharging thereof reduced), and the power consumption may be consequently reduced.

At a third time t3, the emission control signal EM[i−1] of the preceding stage may be supplied to the first input terminal 101. The first clock signal CLK1 may be supplied to the second input terminal 102. The control node signal QB[i−1] of the preceding stage may be supplied to the fourth input terminal 105. When the first clock signal CLK1 is supplied to the second input terminal 102, the first transistor M1, the fourth transistor M4, the fifth transistor M5, and the thirteenth transistor M13 may be turned on.

When the fifth transistor M5 is turned on, the voltage of the first power supply VDD may be supplied to the fifth node N5. Thereby, the high voltage may be supplied to the second electrode of the second capacitor C2.

When the first transistor M1 is turned on, the first input terminal 101, the fourth node N4, and the second node N2 may be electrically coupled to each other. Then, the fourth node N4 and the second node N2 may be set to the high voltage by the emission control signal EM[i−1] of the preceding stage that is supplied to the first input terminal 101. When the fourth node N4 and the second node N2 are set to the high voltage, the eighth transistor M8 and the tenth transistor M10 may be turned off.

When the fourth transistor M4 is turned on, the fourth input terminal 105 and the third node N3 may be electrically coupled to each other. Then, the third node N3 may be set to a low voltage by the control node signal QB[i−1] of the preceding stage that is supplied to the fourth input terminal 105. When the third node N3 is set to the low voltage, the second transistor M2 and the sixth transistor M6 may be turned on. Furthermore, the low voltage may be supplied to the first electrode of the second capacitor C2 coupled to the third node N3. Because the high voltage is supplied to the second electrode of the second capacitor C2, the second capacitor C2 may be charged, and a potential difference between the opposite electrodes of the second capacitor C2 may be set to a high level.

When the second transistor M2 is turned on, the voltage of the first power supply VDD may be supplied to the seventh node N7. Hence, the high voltage may be supplied to the first electrode of the third capacitor C3 coupled to the seventh node N7.

When the sixth transistor M6 is turned on, the second clock signal CLK2 that is supplied to the third input terminal 103 may be supplied to the fifth node N5. Because the second clock signal CLK2 is not supplied to the third input terminal 103 at the third time t3, the high voltage may be supplied to the fifth node N5. Here, the driving performance of the sixth transistor M6 may be enhanced by coupling of the second capacitor C2.

When the thirteenth transistor M13 is turned on, the first input terminal 101 is electrically coupled with the sixth node N6 via the fourteenth transistor M14 that remains turned on. Here, at the third time t3, the emission control signal EM[i−1] of the preceding stage may be supplied to the first input terminal 101, so that a high voltage may be supplied to the sixth node N6. When the high voltage is supplied to the sixth node N6, the third transistor M3 and the fifteenth transistor M15 may be turned off.

Because the high voltage is supplied to the second electrode of the third capacitor C3 that is coupled to the sixth node N6 and the high voltage is supplied to the first electrode of the third capacitor C3, the third capacitor C3 may be discharged, and a potential difference between the opposite electrodes of the third capacitor C3 may be set to a low level.

At a fourth time t4, the second clock signal CLK2 may be supplied to the third input terminal 103. When the second clock signal CLK2 is supplied to the third input terminal 103, the seventh transistor M7 may be turned on.

When the seventh transistor M7 is turned on, the fifth node N5 and the first node N1 may be electrically coupled to each other. Here, the low-level second clock signal CLK2 that is supplied to the third input terminal 103 may be supplied to the fifth node N5 and the first node N1 via the sixth transistor M6 that remains turned on. When the low voltage is supplied to the first node N1, the ninth transistor M9 may be turned on.

When the ninth transistor M9 is turned on, the voltage of the first power supply VDD may be supplied to the first output terminal 104. The voltage of the first power supply VDD that is supplied to the first output terminal 104 may be supplied to the i-th emission control line Ei as the emission control signal EM[i].

Because the first node N1 is set to the low voltage, the control node signal QB[i] may be supplied to the second output terminal 106.

At a fifth time t5, the first clock signal CLK1 may be supplied to the second input terminal 102. When the first clock signal CLK1 is supplied to the second input terminal 102, the first transistor M1, the fourth transistor M4, the fifth transistor M5, and the thirteenth transistor M13 may be turned on.

When the fifth transistor M5 is turned on, the voltage of the first power supply VDD may be supplied to the fifth node N5. Thereby, the high voltage may be supplied to the second electrode of the second capacitor C2.

When the first transistor M1 is turned on, the first input terminal 101, the fourth node N4, and the second node N2 may be electrically coupled to each other. Then, the fourth node N4 and the second node N2 may remain in the high voltage state by the emission control signal EM[i−1] of the preceding stage that is supplied to the first input terminal 101.

When the fourth transistor M4 is turned on, the fourth input terminal 105 and the third node N3 may be electrically coupled to each other. Then, the third node N3 may remain in the low voltage state by the control node signal QB[i−1] of the preceding stage that is supplied to the fourth input terminal 105. Furthermore, the low voltage may be supplied to the first electrode of the second capacitor C2 coupled to the third node N3. Because the high voltage is supplied to the second electrode of the second capacitor C2, the second capacitor C2 may be charged, and the potential difference between the opposite electrodes of the second capacitor C2 may be maintained at the high level.

When the second transistor M2 is turned on, the voltage of the first power supply VDD may be supplied to the seventh node N7. Hence, the high voltage may be supplied to the first electrode of the third capacitor C3 coupled to the seventh node N7.

When the sixth transistor M6 is turned on, the second clock signal CLK2 that is supplied to the third input terminal 103 may be supplied to the fifth node N5. Because the second clock signal CLK2 is not supplied to the third input terminal 103 at the fifth time t5, the high voltage may be supplied to the fifth node N5. Here, the driving performance of the sixth transistor M6 may be enhanced by coupling of the second capacitor C2.

When the thirteenth transistor M13 is turned on, the first input terminal 101 is electrically coupled with the sixth node N6 via the fourteenth transistor M14 that remains turned on. Here, at the third time t3, the emission control signal EM[i−1] of the preceding stage may be supplied to the first input terminal 101, so that a high voltage may be supplied to the sixth node N6. When the high voltage is supplied to the sixth node N6, the third transistor M3 and the fifteenth transistor M15 may be turned off.

Because the high voltage is supplied to the second electrode of the third capacitor C3 that is coupled to the sixth node N6 and the high voltage is supplied to the first electrode of the third capacitor C3, the third capacitor C3 may be discharged, and a potential difference between the opposite electrodes of the third capacitor C3 may be maintained at the low level.

The operation at a sixth time t6 is the same as that at the fourth time t4; therefore, a repeated detailed description thereof will be omitted. During the sixth time t6, the emission control signal EM[i] may remain in the supply state.

The operation after a seventh time t7 is the same as that at the first time t1 and the second time t2. After the seventh time t7, the supply of the emission control signal EM[i−1] (or the start signal FLM) of the preceding stage and the control node signal QB[i−1] (or the control node start signal FQB) of the preceding stage is interrupted. Therefore, the emission control signal EM[i] may not be output. While the emission control signal EM[i] is not supplied after the seventh time t7, as shown in the description of the operation pertaining to the first time t1 and the second time t2, the potential difference between the opposite electrodes of the second capacitor C2 may be maintained at the low level, and the potential difference between the opposite electrodes of the third capacitor C3 may be maintained at the high level.

In other words, in the present disclosure, while the emission control signal EM[i] is disabled, the second capacitor C2 and the third capacitor C3 may be neither charged nor discharged. Therefore, the power consumption of the display device may be reduced.

Figure 10:
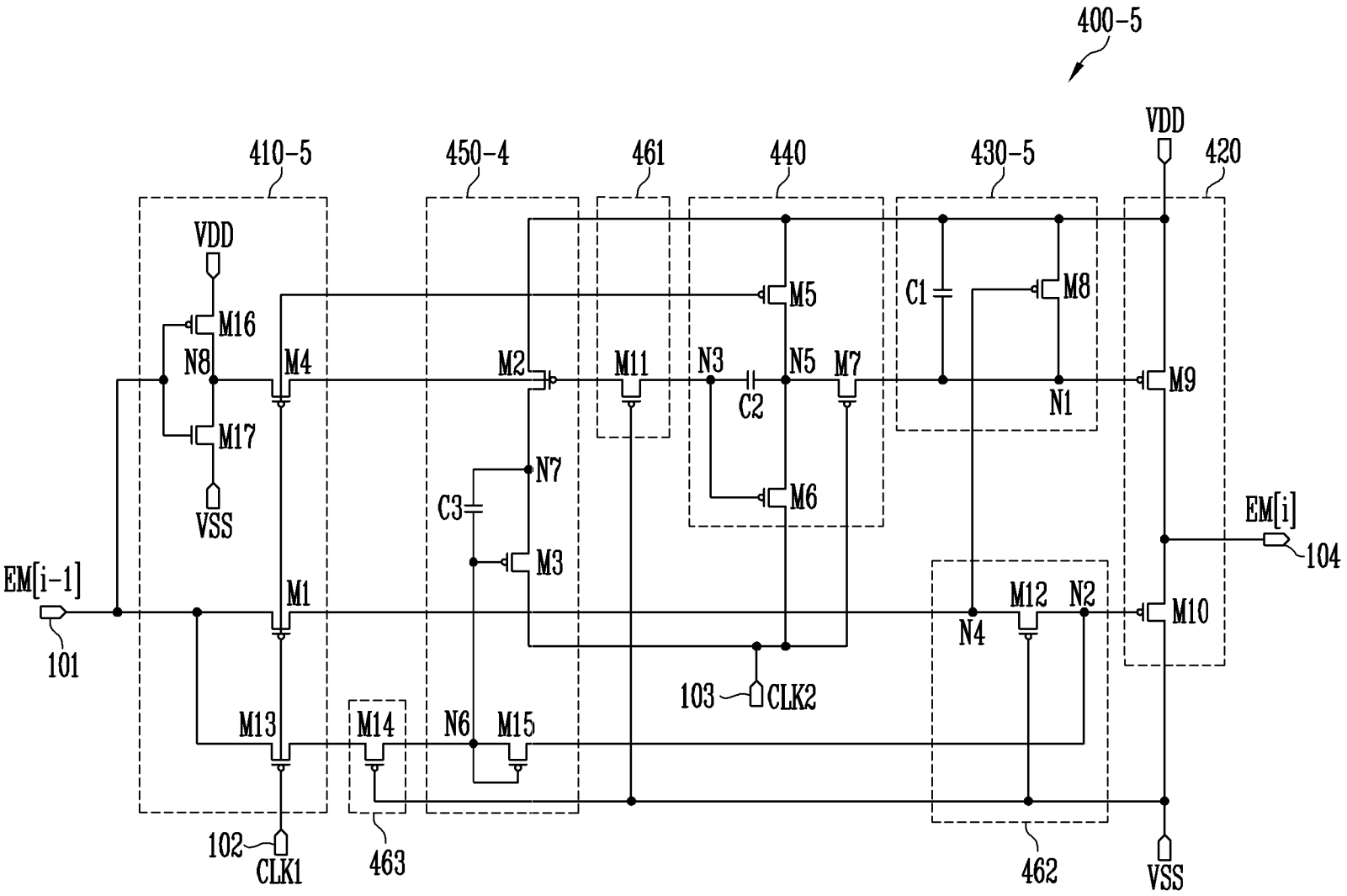
FIG. 10 is a circuit diagram illustrating a stage illustrated in FIG. 2 in accordance with a sixth embodiment of the present disclosure.

FIG. 10 is a circuit diagram illustrating a stage illustrated in FIG. 2 in accordance with a sixth embodiment of the present disclosure. In FIG. 10, the same reference numerals are used to designate the same components as those of FIG. 8, and a repeated detailed description thereof will be omitted.

Referring to FIG. 10, the stage 400-5 in accordance with the sixth embodiment of the present disclosure may include an input unit 410-5, an output unit 420, a first signal processing unit 430-5, a second signal processing unit 440, a third signal processing unit 450-4, and first to third stabilization units 461, 462, and 463.

The input unit 410-5 may control the voltages of a third node N3 and a fourth node N4 in response to signals supplied to a first input terminal 101, and a second input terminal 102. To this end, the input unit 410-5 may include a first transistor M1, a fourth transistor M4, a thirteenth transistor M13, a sixteenth transistor M16, and a seventeenth transistor M17.

The first transistor M1 is coupled between the first input terminal 101 and the fourth node N4. A gate electrode of the first transistor M1 is coupled to the second input terminal 102. When the first clock signal CLK1 is supplied to the second input terminal 102, the first transistor M1 may be turned on to electrically couple the first input terminal 101 with the fourth node N4.

A first electrode of the fourth transistor M4 is coupled to an eighth node N8, and a second electrode thereof is coupled to the third node N3 via an eleventh transistor M11. A gate electrode of the fourth transistor M4 is coupled to the second input terminal 102. When the first clock signal CLK1 is supplied to the second input terminal 102, the fourth transistor M4 may be turned on to electrically couple the eighth node N8 with the third node N3.

A first electrode of the thirteenth transistor M13 is coupled to the first input terminal 101, and a second electrode thereof is coupled to a sixth node N6 via a fourteenth transistor M14. A gate electrode of the thirteenth transistor M13 is coupled to the second input terminal 102. When the first clock signal CLK1 is supplied to the second input terminal 102, the thirteenth transistor M13 may be turned on to electrically couple the first input terminal 101 with the sixth node N6.

The sixteenth transistor M16 is coupled between a first power supply VDD and the eighth node N8. A gate electrode of the sixteenth transistor M16 is coupled to the first input terminal 101. The sixteenth transistor M16 may be formed of a P-type transistor. When a low voltage is supplied to the first input terminal 101, the sixteenth transistor M16 may be turned on so that a high voltage may be supplied to the eighth node N8.

The seventeenth transistor M17 is coupled between the eighth node N8 and a second power supply VSS. A gate electrode of the seventeenth transistor M17 is coupled to the first input terminal 101. The seventeenth transistor M17 may be formed of an N-type transistor. When a high voltage is supplied to the first input terminal 101, the seventeenth transistor M17 may be turned on so that a low voltage may be supplied to the eighth node N8.

The first signal processing unit 430-5 may control the voltage of the first node N1 in response to a voltage of the fourth node N4. The first signal processing unit 430-5 may supply the voltage of the first power supply VDD to the first node N1 in response to the voltage of the fourth node N4. To this end, the first signal processing unit 430-5 may include an eighth transistor M8 and a first capacitor C1.

The eighth transistor M8 is coupled between the first power supply VDD and the first node N1. A gate electrode of the eighth transistor M8 may be coupled to the fourth node N4. The eighth transistor M8 may be turned on or off depending on the voltage of the fourth node N4.

The first capacitor C1 is coupled between the first power supply VDD and the first node N1. The first capacitor C1 may charge a voltage to be applied to the first node N1. Furthermore, the first capacitor C1 may stably maintain the voltage of the first node N1.

In the sixth embodiment of the present disclosure, the emission control signal EM[i−1] of the preceding stage may be inverted using the sixteenth transistor M16 and the seventeenth transistor M17 that are formed as an inverter, and may then be supplied to the third node N3. In this case, the stage 400-5 according to the sixth embodiment has the same configuration as that of FIG. 8 except that the control node signal QB[i−1] of the preceding stage is replaced with the emission control signal EM[i−1] of the preceding stage. Therefore, detailed description of the process of the operation will be omitted.

Figure 11:
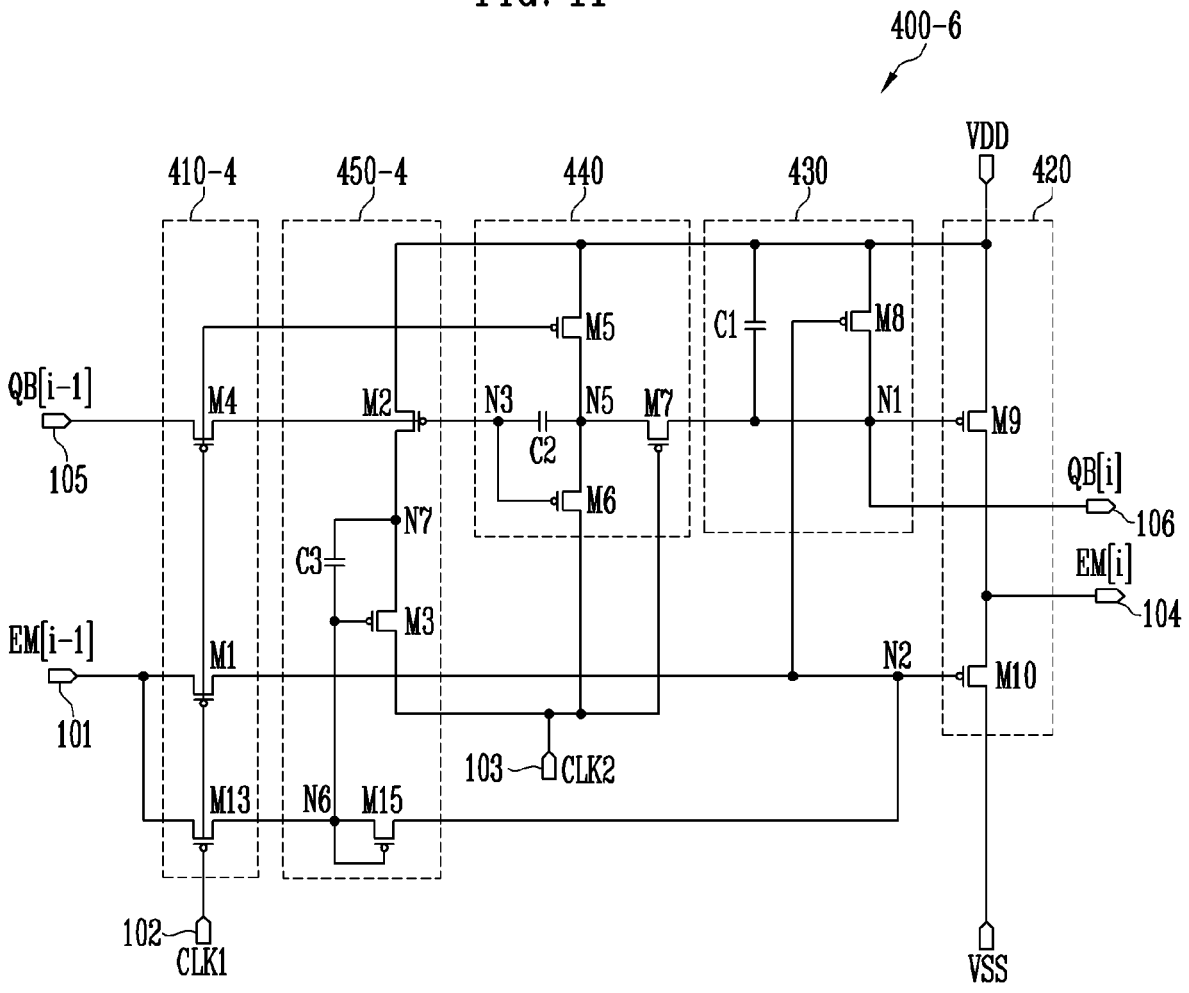
FIG. 11 is a circuit diagram illustrating a stage illustrated in FIG. 2 in accordance with a seventh embodiment of the present disclosure.

FIG. 11 is a circuit diagram illustrating a stage illustrated in FIG. 2 in accordance with a seventh embodiment of the present disclosure. In FIG. 11, the same reference numerals are used to designate the same components as those of FIG. 8, and a repeated detailed description thereof will be omitted.

Referring to FIG. 11, a stage 400-6 in accordance with the seventh embodiment of the present disclosure may include an input unit 410-4, an output unit 420, a first signal processing unit 430, a second signal processing unit 440, and a third signal processing unit 450-4.

The stage 400-6 according to the seventh embodiment has the same configuration as that of FIG. 8 except that the first to third stabilization units 461, 462, and 463 are omitted. Therefore, detailed description of the process of the operation will be omitted.

Figure 12:
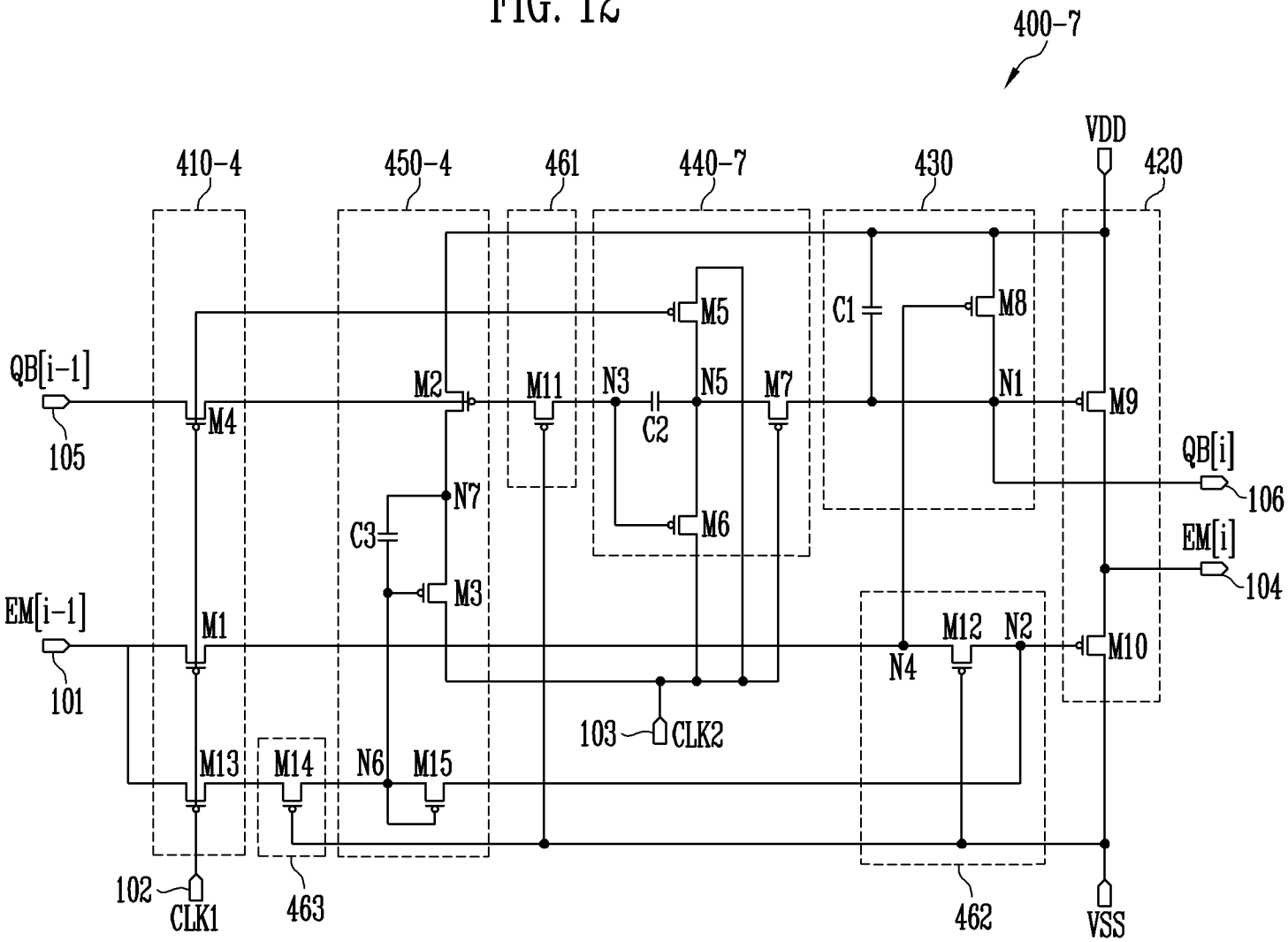
FIG. 12 is a circuit diagram illustrating a stage illustrated in FIG. 2 in accordance with an eighth embodiment of the present disclosure.

FIG. 12 is a circuit diagram illustrating a stage illustrated in FIG. 2 in accordance with an eighth embodiment of the present disclosure. In FIG. 12, the same reference numerals are used to designate the same components as those of FIG. 8, and a repeated detailed description thereof will be omitted.

Referring to FIG. 12, the stage 400-7 in accordance with the eighth embodiment of the present disclosure may include an input unit 410-4, an output unit 420, a first signal processing unit 430, a second signal processing unit 440-7, a third signal processing unit 450-4, and first to third stabilization units 461, 462, and 463.

The second signal processing unit 440-7 is coupled to a third node N3, and may control the voltage of a first node N1 in response to a signal input to a third input terminal 103. To this end, the second signal processing unit 440-7 may include a seventh transistor M7, a sixth transistor M6, a fifth transistor M5, and a second capacitor C2.

A first terminal of the second capacitor C2 is coupled to the third node N3, and a second terminal thereof is coupled to a fifth node N5.

The seventh transistor M7 is coupled between the fifth node N5 and the first node N1. A gate electrode of the seventh transistor M7 is coupled to the third input terminal 103. When the second clock signal CLK2 is supplied to the third input terminal 103, the seventh transistor M7 may be turned on to electrically couple the fifth node N5 with the first node N1.

The sixth transistor M6 is coupled between the fifth node N5 and the third input terminal 103. A gate electrode of the sixth transistor M6 is coupled to the third node N3. The sixth transistor M6 may be turned on or off depending on the voltage of the third node N3.

The fifth transistor M5 is coupled between the third input terminal 103 and the fifth node N5. A gate electrode of the fifth transistor M5 is coupled to the second input terminal 102. The fifth transistor M5 may be turned on or off in response to the first clock signal CLK1 supplied to the second input terminal 102.

The stage 400-7 according to the eighth embodiment has the same configuration as that of FIG. 8 except that the fifth transistor M5 of the second signal processing unit 440-7 is coupled to the third input terminal 103 rather than the first power supply VDD. Therefore, detailed description of the process of the operation will be omitted.

In each of the embodiments described with reference to FIGS. 3 to 12, the stages may be formed of the same circuit. However, in some embodiments of the present disclosure, stages may be formed of different circuits. Hereinafter, these embodiments will be described in more detail with reference to FIGS. 13 and 14.

Figure 13:
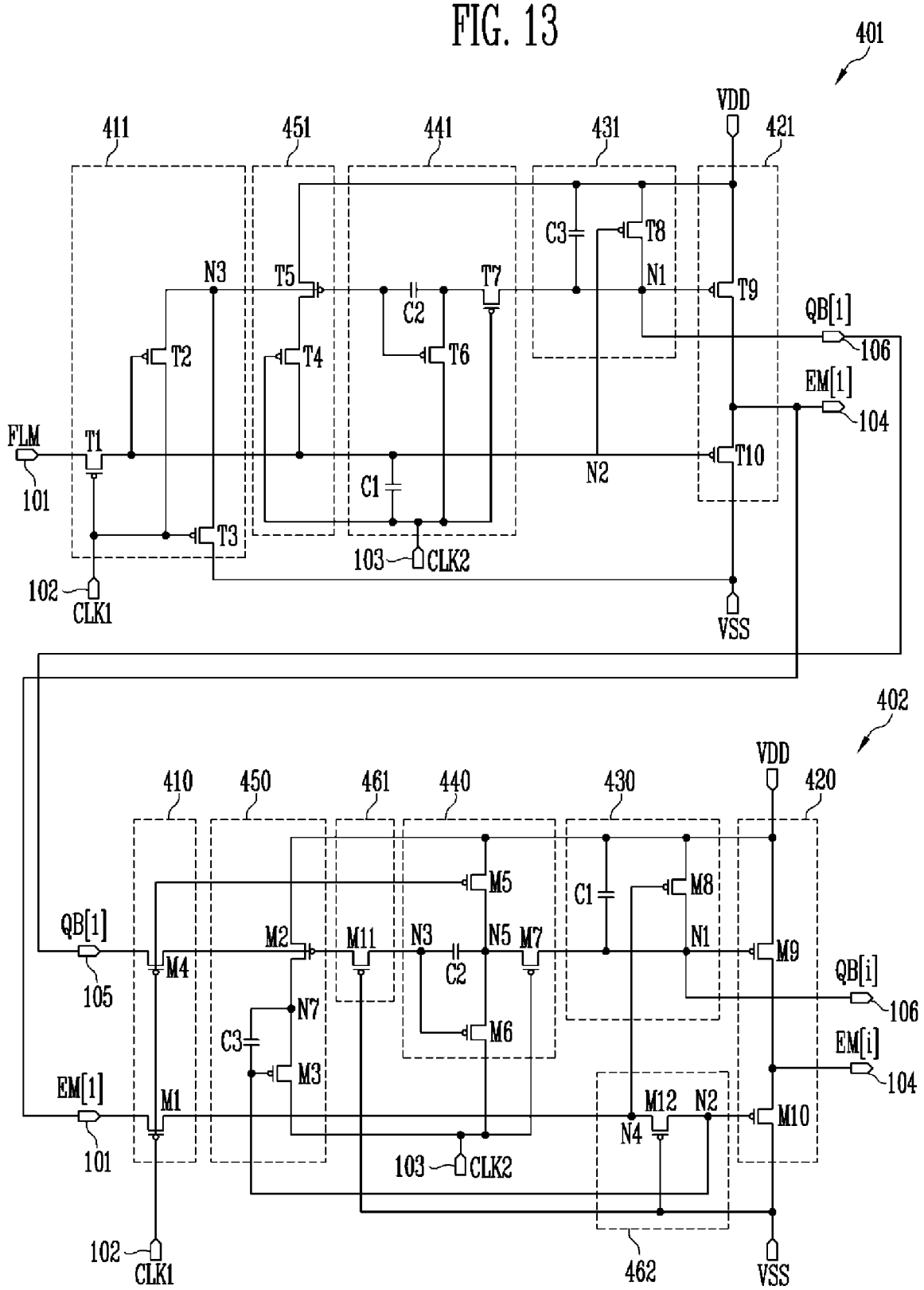
FIG. 13 is a circuit diagram illustrating a first embodiment of a structure including stages formed of different circuits in accordance with the present disclosure.

FIG. 13 is a circuit diagram illustrating a first embodiment of a structure including stages formed of different circuits in accordance with the present disclosure. For the sake of explanation, FIG. 13 illustrates only a first stage 401 and a second stage 402.

Referring to FIG. 13, the first stage 401 may include an input unit 411, an output unit 421, a first signal processing unit 431, a second signal processing unit 441, and a third signal processing unit 451.

The output unit 421 may supply the voltage of a first power supply VDD or a second power supply VSS to a first output terminal 104 depending on voltages of a first node N1 and a second node N2. To this end, the output unit 421 may include a ninth transistor T9 and a tenth transistor T10.

The ninth transistor T9 is coupled between the first power supply VDD and the first output terminal 104. A gate electrode of the ninth transistor T9 is coupled to the first node N1. The ninth transistor T9 may be turned on or off depending on the voltage of the first node N1. Here, the voltage of the first power supply VDD that is supplied to the first output terminal 104 when the ninth transistor T9 is turned on may be used as an emission control signal of the first emission control line E1.

The tenth transistor T10 is coupled between the first output terminal 104 and the second power supply VSS. A gate electrode of the tenth transistor T10 is coupled to the second node N2. The tenth transistor T10 may be turned on or off depending on the voltage of the second node N2.

The input unit 411 may control the voltages of a third node N3 and the second node N2 in response to signals supplied to a first input terminal 101 and a second input terminal 102. To this end, the input unit 411 may include a first transistor T1, a second transistor T2, and a third transistor T3.

The first transistor T1 is coupled between the first input terminal 101 and the second node N2. A gate electrode of the first transistor T1 is coupled to the second input terminal 102. When the first clock signal CLK1 is supplied to the second input terminal 102, the first transistor T1 may be turned on to electrically couple the first input terminal 101 with the second node N2.

The second transistor T2 is coupled between the third node N3 and the second input terminal 102. A gate electrode of the second transistor T2 is coupled to the second node N2. When the first clock signal CLK1 is supplied to the second input terminal 102, the first transistor T1 may be turned on to electrically couple the first input terminal 101 with the gate electrode of the second transistor T2.

The third transistor T3 is coupled between the third node N3 and the second power supply VSS. A gate electrode of the third transistor T3 is coupled to the second input terminal 102. When the first clock signal CLK1 is supplied to the second input terminal 102, the third transistor T3 may be turned on so that the voltage of the second power supply VSS may be supplied to the third node N3.

The first signal processing unit 431 may control the voltage of the first node N1 in response to a voltage of the second node N2. To this end, the first signal processing unit 431 may include an eighth transistor T8 and a third capacitor C3.

The eighth transistor T8 is coupled between the first power supply VDD and the first node N1. A gate electrode of the eighth transistor T8 is coupled to the second node N2. The eighth transistor T8 may be turned on or off depending on the voltage of the second node N2. Here, the voltage of the first power supply VDD that is supplied to the second output terminal 106 when the eighth transistor T8 is turned on may be supplied to a fourth input terminal 105 of the second stage 402 as a control node signal QB.

The third capacitor C3 is coupled between the first power supply VDD and the first node N1. The third capacitor C3 may charge a voltage to be applied to the first node N1. Furthermore, the third capacitor C3 may stably maintain the voltage of the first node N1.

The second signal processing unit 441 is coupled to the third node N3, and may control the voltage of the first node N1 in response to a signal input to the third input terminal 103. To this end, the second signal processing unit 441 may include a sixth transistor T6, a seventh transistor T7, a first capacitor C1, and a second capacitor C2.

The first capacitor C1 is coupled between the second node N2 and the third input terminal 103. The first capacitor C1 may charge a voltage to be applied to the second node N2. The first capacitor C1 controls the voltage of the second node N2 in response to the second clock signal CLK2 supplied to the third input terminal 103.

A first terminal of the second capacitor C2 is coupled to the third node N3, and a second terminal thereof is coupled to the seventh transistor T7.

The sixth transistor T6 is coupled between the second terminal of the second capacitor C2 and the third input terminal 103. A gate electrode of the sixth transistor T6 is coupled to the third node N3. The sixth transistor T6 may be turned on or off depending on the voltage of the third node N3.

The seventh transistor T7 is coupled between the second terminal of the second capacitor C2 and the first node N1. A gate electrode of the seventh transistor T7 is coupled to the third input terminal 103. When the second clock signal CLK2 is supplied to the third input terminal 103, the seventh transistor T7 may be turned on to electrically couple the second terminal of the second capacitor C2 with the first node N1.

The third signal processing unit 451 may control the voltage of the second node N2 in response to the voltage of the third node N3 and a signal input to the third input terminal 103. To this end, the third signal processing unit 451 may include a fourth transistor T4 and a fifth transistor T5.

The fourth transistor T4 and the fifth transistor T5 are coupled in series between the first power supply VDD and the second node N2. A gate electrode of the fourth transistor T4 is coupled to the third input terminal 103. The fourth transistor T4 may be turned on when the second clock signal CLK2 is supplied to the third input terminal 103. A gate electrode of the fifth transistor T5 is coupled to the third node N3. The fifth transistor T5 may be turned on or off depending on the voltage of the third node N3.

In other embodiments, the first stage 401 may further include the first stabilization unit 461 and the second stabilization unit 462 that have been described with reference to FIGS. 3 to 7.

The second stage 402 may have a configuration that is different from that of the first stage 401, and may be formed of any one of the circuits in accordance with the embodiments described with reference to FIGS. 3 to 12.

Although in FIG. 13 the second stage 402 has been illustrated as having the configuration in accordance with the embodiment of FIG. 3, this is only for illustrative purposes, and the present disclosure is not limited thereto.

Figure 14:
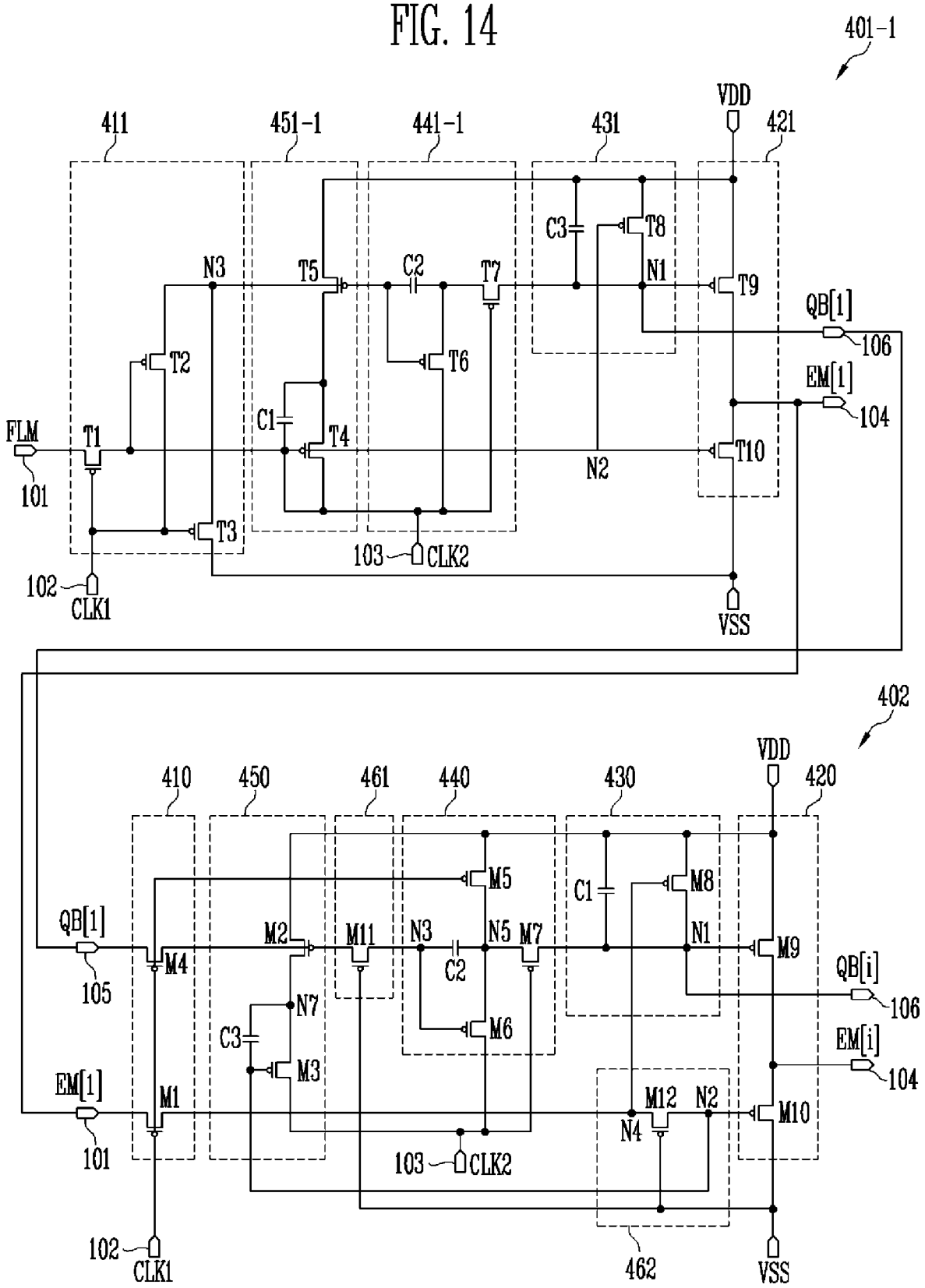
FIG. 14 is a circuit diagram illustrating a second embodiment of a structure including stages formed of different circuits in accordance with the present disclosure.

FIG. 14 is a circuit diagram illustrating a second embodiment of a structure including stages formed of different circuits in accordance with the present disclosure. For the sake of explanation, FIG. 14 illustrates only a first stage 401-1 and a second stage 402. In FIG. 14, the same reference numerals are used to designate the same components as those of FIG. 13, and a repeated detailed description thereof will be omitted.

Referring to FIG. 14, the first stage 401-1 may include an input unit 411, an output unit 421, a first signal processing unit 431, a second signal processing unit 441-1, and a third signal processing unit 451-1.

The second signal processing unit 441-1 is coupled to the third node N3, and may control the voltage of a first node N1 in response to a signal input to a third input terminal 103. To this end, the second signal processing unit 441-1 may include a sixth transistor T6, a seventh transistor T7, and a second capacitor C2.

A first terminal of the second capacitor C2 is coupled to the third node N3, and a second terminal thereof is coupled to the seventh transistor T7.

The sixth transistor T6 is coupled between the second terminal of the second capacitor C2 and the third input terminal 103. A gate electrode of the sixth transistor T6 is coupled to the third node N3. The sixth transistor T6 may be turned on or off depending on the voltage of the third node N3.

The seventh transistor T7 is coupled between the second terminal of the second capacitor C2 and the first node N1. A gate electrode of the seventh transistor T7 is coupled to the third input terminal 103. When the second clock signal CLK2 is supplied to the third input terminal 103, the seventh transistor T7 may be turned on to electrically couple the second terminal of the second capacitor C2 with the first node N1.

The third signal processing unit 451-1 may control the voltage of a second node N2 in response to the voltage of the third node N3 and a signal input to the third input terminal 103. To this end, the third signal processing unit 451-1 may include a fourth transistor T4, a fifth transistor T5, and a first capacitor C1.

The fourth transistor T4 and the fifth transistor T5 are coupled in series between the first power supply VDD and the third input terminal 103. A gate electrode of the fifth transistor T5 is coupled to the third node N3. The fifth transistor T5 may be turned on or off depending on the voltage of the third node N3.

A gate electrode of the fourth transistor T4 is coupled to the third input terminal 103. The fourth transistor T4 may be turned on when the second clock signal CLK2 is supplied to the third input terminal 103.

The first capacitor C1 is coupled between a common node between the fourth transistor T4 and the fifth transistor T5 and the second node N2.

The second stage 402 may have a configuration that is different from that of the first stage 401-1, and may be formed of any one of the circuits in accordance with the embodiments described with reference to FIGS. 3 to 12.

Although in FIG. 14 the second stage 402 has been illustrated as having the configuration in accordance with the embodiment of FIG. 3, this is only for illustrative purposes, and the present disclosure is not limited thereto.

In a stage and in an emission control driver having the same in accordance with embodiments of the present disclosure, a capacitor provided in the stage may be prevented from being charged or discharged while an emission control signal is maintained at a low voltage, whereby the power consumption of a display device may be reduced.

Furthermore, in a stage and an emission control driver having the same in accordance with embodiments of the present disclosure, the voltage of a certain node remains constant during a period in which the emission control signal is supplied. Thereby, the driving reliability may be secured.

It will be understood to those skilled in the art that the present disclosure may be implemented in different specific forms without changing the technical ideas or essential characteristics. Therefore, it should be understood that the exemplary embodiments are only for illustrative purposes and do not limit the bounds of the present invention. It is intended that the bounds of the present disclosure are defined by the accompanying claims, and various modifications, additions and substitutions, which can be derived from the meaning, scope and equivalent concepts of the accompanying claims, fall within the bounds of the present disclosure.

What is claimed is:

1. A stage comprising:

an output unit configured to supply a voltage of a first power supply or a voltage of a second power supply to a first output terminal depending on a voltage of a first node as a first input of the output unit and depending on a voltage of a second node as a second input of the output unit;

an input unit configured to control the voltage of the second node via a first output of the input unit electrically connected thereto, and to control a voltage of a third node via a second output of the input unit electrically connected thereto, in response to signals supplied to a first input terminal, a second input terminal, and a fourth input terminal;

a first signal processing unit configured to control the voltage of the first node via a first output of the first signal processing unit electrically connected thereto in response to the voltage of the second node, and to supply a voltage corresponding to the first node to a second output terminal;

a second signal processing unit comprising a second capacitor coupled between the third node and a fifth node, the second signal processing unit being configured to control the voltage of the first node via a first output of the second signal processing unit electrically connected thereto in response to the signal supplied to the second input terminal and to a signal supplied to a third input terminal, and being configured to control a potential difference between opposite terminals of the second capacitor in response to the signal supplied to the second input terminal and the voltage of the first power supply; and a third signal processing unit configured to control the voltage of the second node via a first output of the third signal processing unit electrically connected thereto in response to the voltage of the first power supply and the signal supplied to the fourth input terminal, the signal supplied to the fourth input terminal being variable, wherein the signal supplied to the first input terminal comprises a start signal or a signal output from the first output terminal of a preceding stage, wherein the signal supplied to the fourth input terminal comprises a control node start signal or a signal output from the second output terminal of the preceding stage, and wherein the signal output from the second output terminal of the preceding stage or the control node start signal has a phase that is inverted from a phase of the signal output from the first output terminal of the preceding stage or the start signal.

2. The stage according to claim 1, wherein the first power supply is set to a gate-off voltage, and the second power supply is set to a gate-on voltage.

3. The stage according to claim 1, wherein the signal output from the first output terminal of the preceding stage or the start signal overlaps at least once with a first clock signal comprising the signal supplied to the second input terminal.

4. The stage according to claim 1, wherein the signal supplied to the second input terminal comprises a first clock signal, and wherein the signal supplied to the third input terminal comprises a second clock signal.

5. The stage according to claim 1, wherein the input unit comprises:

a first transistor coupled between the first input terminal and the second node, and comprising a gate electrode coupled to the second input terminal; and a fourth transistor coupled between the fourth input terminal and the third node, and comprising a gate electrode coupled to the second input terminal.

6. The stage according to claim 1, wherein the output unit comprises:

a ninth transistor coupled between the first power supply and the first output terminal, and comprising a gate electrode coupled to the first node; and a tenth transistor coupled between the first output terminal and the second power supply, and comprising a gate electrode coupled to the second node.

7. The stage according to claim 1, wherein the first signal processing unit comprises:

an eighth transistor coupled between the first power supply and the first node, and comprising a gate electrode coupled to the second node; and a first capacitor coupled between the first power supply and the first node.

8. The stage according to claim 1, wherein the second signal processing unit comprises:

a fifth transistor coupled between the first power supply and the fifth node, and comprising a gate electrode coupled to the second input terminal;

a sixth transistor coupled between the fifth node and the third input terminal, and comprising a gate electrode coupled to the third node; and a seventh transistor coupled between the fifth node and the first node, and comprising a gate electrode coupled to the third input terminal.

9. The stage according to claim 8, wherein, while the voltage of the second power supply is supplied to the first output terminal, the potential difference between the opposite terminals of the second capacitor remains constant.

10. The stage according to claim 1, wherein the third signal processing unit comprises:

a second transistor coupled between the first power supply and a seventh node, and comprising a gate electrode coupled to the third node;

a third transistor coupled between the seventh node and the third input terminal, and comprising a gate electrode coupled to the second node; and a third capacitor coupled between the seventh node and the second node.

11. The stage according to claim 1, further comprising:

a first stabilization unit coupled between the second signal processing unit and the third signal processing unit, and configured to control a voltage drop width of the third node corresponding to an amount of time for a voltage drop at the third node to occur; and a second stabilization unit coupled between the second node and a fourth node coupled to the first input terminal, the second stabilization unit being configured to control a voltage drop width of the second node corresponding to an amount of time for a voltage drop at the second node to occur.

12. The stage according to claim 11, wherein the first stabilization unit comprises an eleventh transistor coupled between the third signal processing unit and the third node, and comprising a gate electrode coupled to the second power supply.

13. The stage according to claim 11, wherein the second stabilization unit comprises a twelfth transistor coupled between the second node and the output unit, and comprising a gate electrode coupled to the second power supply.

14. The stage according to claim 1, wherein the input unit comprises:

a first transistor coupled between the first input terminal and the second node, and comprising a gate electrode coupled to the second input terminal;

a fourth transistor coupled between an eighth node and the third node;

a sixteenth transistor coupled between the first power supply and the eighth node, and comprising a gate electrode coupled to the first input terminal; and a seventeenth transistor coupled between the eighth node and the second power supply, and comprising a gate electrode coupled to the first input terminal, and wherein the fourth input terminal is coupled to the first input terminal.

15. The stage according to claim 1, wherein the second signal processing unit comprises:

a fifth transistor coupled between the third input terminal and the fifth node, and comprising a gate electrode coupled to the second input terminal;

a sixth transistor coupled between the fifth node and the third input terminal, and comprising a gate electrode coupled to the third node; and a seventh transistor coupled between the fifth node and the first node, and comprising a gate electrode coupled to the third input terminal.

16. The stage according to claim 1, wherein the third signal processing unit comprises a third capacitor coupled between a sixth node and a seventh node, and is configured to control a potential difference between opposite terminals of the third capacitor in response to the first power supply and the signals supplied to the first input terminal, the second input terminal, and the fourth input terminal.

17. The stage according to claim 16, wherein the third signal processing unit further comprises:

a second transistor coupled between the first power supply and the seventh node, and comprising a gate electrode coupled to the third node;

a third transistor coupled between the seventh node and the third input terminal, and comprising a gate electrode coupled to the sixth node; and a fifteenth transistor coupled between the sixth node and the second node, and comprising a gate electrode coupled to the sixth node.

18. The stage according to claim 17, wherein the input unit comprises:

a first transistor coupled between the first input terminal and the second node, and comprising a gate electrode coupled to the second input terminal;

a fourth transistor coupled between the fourth input terminal and the third node, and comprising a gate electrode coupled to the second input terminal; and a thirteenth transistor coupled between the first input terminal and the sixth node, and comprising a gate electrode coupled to the second input terminal.

19. The stage according to claim 18, wherein, while the voltage of the second power supply is supplied to the first output terminal, the potential difference between the opposite terminals of the third capacitor remains constant.

20. The stage according to claim 18, further comprising:

a first stabilization unit coupled between the second signal processing unit and the third signal processing unit, and configured to control a voltage drop width of the third node corresponding to an amount of time for a voltage drop at the third node to occur;

a second stabilization unit coupled between the second node and a fourth node that is coupled to the first input terminal, and configured to control a voltage drop width of the fourth node corresponding to an amount of time for a voltage drop at the fourth node to occur; and a third stabilization unit coupled between the input unit and the third signal processing unit, and configured to control a voltage drop width of the sixth node corresponding to an amount of time for a voltage drop at the sixth node to occur.

21. The stage according to claim 17, wherein the input unit comprises:

a first transistor coupled between the first input terminal and the second node, and comprising a gate electrode coupled to the second input terminal;

a fourth transistor coupled between an eighth node and the third node;

a thirteenth transistor coupled between the first input terminal and the sixth node, and comprising a gate electrode coupled to the second input terminal;

a sixteenth transistor coupled between the first power supply and the eighth node, and comprising a gate electrode coupled to the first input terminal; and a seventeenth transistor coupled between the eighth node and the second power supply, and comprising a gate electrode coupled to the first input terminal, and wherein the fourth input terminal is coupled to the first input terminal.

22. An emission control driver comprising a plurality of stages to supply emission signals to emission control lines, the plurality of stages comprising:

an output unit configured to supply a voltage of a first power supply or a second power supply to a first output terminal depending on voltages of a first node as a first input of the output unit and of a second node as a second input of the output unit;

an input unit configured to control the voltage of the second node via a first output of the input unit electrically connected thereto, and to control a voltage of a third node via a second output of the input unit electrically connected thereto, in response to signals supplied to a first input terminal, a second input terminal, and a fourth input terminal;

a first signal processing unit configured to control the voltage of the first node via a first output of the first signal processing unit electrically connected thereto in response to the voltage of the second node, and to supply a voltage corresponding to the first node to a second output terminal;

a second signal processing unit comprising a second capacitor coupled between the third node and a fifth node, the second signal processing unit being configured to control the voltage of the first node via a first output of the second signal processing unit electrically connected thereto in response to the signal supplied to the second input terminal and a signal supplied to a third input terminal, and to control a potential difference between opposite terminals of the second capacitor in response to the signal supplied to the second input terminal and the first power supply; and a third signal processing unit configured to control the voltage of the second node via a first output of the third signal processing unit electrically connected thereto in response to the signal supplied to the first input terminal and the signal supplied to the fourth input terminal, the signal supplied to the fourth input terminal being variable, wherein a 1st stage of the plurality of stages comprises:

a 1st output unit configured to supply the voltage of the first power supply or the second power supply to a 1st first-output terminal depending on voltages of a 1st first-node and a 1st second-node;

a 1st input unit configured to control the voltage of the 1st second-node and a voltage of a 1st third-node in response to a signal supplied to a 1st first-input terminal and a signal supplied to a 1st second-input terminal;

a 1st first-signal processing unit configured to control the voltage of the 1st first-node in response to the voltage of the 1st second-node, and to supply a voltage corresponding to the 1st first-node to a 1st second-output terminal;

a 1st second-signal processing unit coupled to the 1st third-node and configured to control the voltage of the 1st first-node in response to the signal supplied to the 1st second-input terminal and a signal supplied to a 1st third-input terminal; and a 1st third-signal processing unit configured to control the voltage of the 1st second-node in response to the signal supplied to the 1st first-input terminal.

23. The emission control driver according to claim 22, wherein a signal output from the 1st second-output terminal is supplied to the fourth input terminal of a 2nd stage.

24. The emission control driver according to claim 22, wherein the first input terminal is supplied with a signal output from the first output terminal of a preceding stage or a start signal, and wherein the fourth input terminal is supplied with a signal output from the second output terminal of the preceding stage or a control node start signal.

25. The emission control driver according to claim 24, wherein the signal output from the first output terminal of the preceding stage or the start signal overlaps at least once with a first clock signal supplied to the second input terminal, and wherein the signal output from the second output terminal of the preceding stage or the control node start signal comprises a signal having a phase that is inverted from a phase of the signal output from the first output terminal of the preceding stage or the start signal.

26. The emission control driver according to claim 22, wherein the input unit comprises:

a first transistor coupled between the first input terminal and the second node, and comprising a gate electrode coupled to the second input terminal; and a fourth transistor coupled between the fourth input terminal and the third node, and comprising a gate electrode coupled to the second input terminal.

27. The emission control driver according to claim 22, wherein the output unit comprises:

a ninth transistor coupled between the first power supply and the first output terminal, and comprising a gate electrode coupled to the first node; and a tenth transistor coupled between the first output terminal and the second power supply, and comprising a gate electrode coupled to the second node.

28. The emission control driver according to claim 22, wherein the first signal processing unit comprises:

an eighth transistor coupled between the first power supply and the first node, and comprising a gate electrode coupled to the second node; and a first capacitor coupled between the first power supply and the first node.

29. The emission control driver according to claim 22, wherein the second signal processing unit comprises:

a fifth transistor coupled between the first power supply and the fifth node, and comprising a gate electrode coupled to the second input terminal;

a sixth transistor coupled between the fifth node and the third input terminal, and comprising a gate electrode coupled to the third node; and a seventh transistor coupled between the fifth node and the first node, and comprising a gate electrode coupled to the third input terminal.

30. The emission control driver according to claim 22, wherein, while the voltage of the second power supply is supplied to the first output terminal, the potential difference between the opposite terminals of the second capacitor remains constant.

31. The emission control driver according to claim 22, wherein the third signal processing unit comprises:

a second transistor coupled between the first power supply and a seventh node, and comprising a gate electrode coupled to the third node;

a third transistor coupled between the seventh node and the third input terminal, and comprising a gate electrode coupled to the second node; and a third capacitor coupled between the seventh node and the second node.

32. The emission control driver according to claim 22, further comprising:

a first stabilization unit coupled between the second signal processing unit and the third signal processing unit, and configured to control a voltage drop width of the third node corresponding to an amount of time for a voltage drop at the third node to occur; and a second stabilization unit coupled between the second node and a fourth node that is coupled to the first input terminal, the second stabilization unit being configured to control a voltage drop width of the second node corresponding to an amount of time for a voltage drop at the second node to occur.

33. The emission control driver according to claim 32, wherein the first stabilization unit comprises an eleventh transistor coupled between the third signal processing unit and the third node, and comprising a gate electrode coupled to the second power supply, and wherein the second stabilization unit comprises a twelfth transistor coupled between the second node and the output unit, and comprising a gate electrode coupled to the second power supply.

34. The emission control driver according to claim 22, wherein the input unit comprises:

a first transistor coupled between the first input terminal and the second node, and comprising a gate electrode coupled to the second input terminal;

a fourth transistor coupled between an eighth node and the third node;

a sixteenth transistor coupled between the first power supply and the eighth node, and comprising a gate electrode coupled to the first input terminal; and a seventeenth transistor coupled between the eighth node and the second power supply, and comprising a gate electrode coupled to the first input terminal, and wherein the fourth input terminal is coupled to the first input terminal.

35. The emission control driver according to claim 22, wherein the second signal processing unit comprises:

a fifth transistor coupled between the third input terminal and the fifth node, and comprising a gate electrode coupled to the second input terminal;

a sixth transistor coupled between the fifth node and the third input terminal, and comprising a gate electrode coupled to the third node; and a seventh transistor coupled between the fifth node and the first node, and comprising a gate electrode coupled to the third input terminal.

36. The emission control driver according to claim 22, wherein the third signal processing unit comprises a third capacitor coupled between a sixth node and a seventh node, and controls a potential difference between opposite terminals of the third capacitor in response to the first power supply and the signals supplied to the first input terminal, the second input terminal, and the fourth input terminal.

37. The emission control driver according to claim 36, wherein the third signal processing unit further comprises:

a second transistor coupled between the first power supply and the seventh node, and comprising a gate electrode coupled to the third node;

a third transistor coupled between the seventh node and the third input terminal, and comprising a gate electrode coupled to the sixth node; and a fifteenth transistor coupled between the sixth node and the second node, and comprising a gate electrode coupled to the sixth node.

38. The emission control driver according to claim 37, wherein the input unit comprises:

a first transistor coupled between the first input terminal and the second node, and comprising a gate electrode coupled to the second input terminal;

a fourth transistor coupled between the fourth input terminal and the third node, and comprising a gate electrode coupled to the second input terminal; and a thirteenth transistor coupled between the first input terminal and the sixth node, and comprising a gate electrode coupled to the second input terminal.

39. The emission control driver according to claim 38, wherein, while the voltage of the second power supply is supplied to the first output terminal, the potential difference between the opposite terminals of the third capacitor remains constant.

40. The emission control driver according to claim 38, further comprising:

a first stabilization unit coupled between the second signal processing unit and the third signal processing unit and configured to control a voltage drop width of the third node corresponding to an amount of time for a voltage drop at the third node to occur;

a second stabilization unit coupled between the second node and a fourth node that is coupled to the first input terminal, the second stabilization unit being configured to control a voltage drop width of the second node corresponding to an amount of time for a voltage drop at the second node to occur; and a third stabilization unit coupled between the input unit and the third signal processing unit, and configured to control a voltage drop width of the sixth node corresponding to an amount of time for a voltage drop at the sixth node to occur.

41. The emission control driver according to claim 37, wherein the input unit comprises:

a first transistor coupled between the first input terminal and the second node, and comprising a gate electrode coupled to the second input terminal;

a fourth transistor coupled between an eighth node and the third node;

a thirteenth transistor coupled between the first input terminal and the sixth node, and comprising a gate electrode coupled to the second input terminal;

a sixteenth transistor coupled between the first power supply and the eighth node, and comprising a gate electrode coupled to the first input terminal; and a seventeenth transistor coupled between the eighth node and the second power supply, and comprising a gate electrode coupled to the first input terminal, and wherein the fourth input terminal is coupled to the first input terminal.

* * * * *